US011222578B2

(12) United States Patent
Kim

(10) Patent No.: US 11,222,578 B2
(45) Date of Patent: Jan. 11, 2022

(54) DISPLAY DEVICE AND METHOD OF DRIVING THE SAME

(71) Applicant: Samsung Display Co., Ltd., Yongin-Si (KR)

(72) Inventor: Won Tae Kim, Yongin-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 17/154,489

(22) Filed: Jan. 21, 2021

(65) Prior Publication Data

US 2021/0375188 A1 Dec. 2, 2021

(30) Foreign Application Priority Data

May 28, 2020 (KR) ..... 10-2020-0064180

(51) Int. Cl.
*G09G 3/3266* (2016.01)
*G09G 3/20* (2006.01)

(52) U.S. Cl.
CPC ... *G09G 3/2092* (2013.01); *G09G 2300/0819* (2013.01); *G09G 2310/0275* (2013.01); *G09G 2310/08* (2013.01)

(58) Field of Classification Search
CPC ..... G09G 3/2092; G09G 2300/0819; G09G 2310/08; G09G 2310/0275
See application file for complete search history.

(56) References Cited

U.S. PATENT DOCUMENTS 9,865,217 B2 1/2018 Won et al.
10,157,586 B2 * 12/2018 Koh ..... G09G 3/3696
10,262,608 B2 * 4/2019 Ahn ..... G09G 3/3648
10,324,319 B2 * 6/2019 Lee ..... G02F 1/13306
10,923,065 B2 * 2/2021 Wang ..... G09G 3/3677
2007/0052656 A1 * 3/2007 Park ..... G09G 3/3677 345/100
2007/0085798 A1 * 4/2007 Hashimoto ..... G09G 3/3688 345/93
2015/0302816 A1 * 10/2015 Won ..... G09G 3/3685 345/87
2016/0086561 A1 * 3/2016 Kim ..... G09G 3/3696 345/92

(Continued)

FOREIGN PATENT DOCUMENTS

KR 10-2015-0121738 A 10/2015
KR 10-2016-0084928 A 7/2016

(Continued)

*Primary Examiner* — Jose R Soto Lopez

(74) *Attorney, Agent, or Firm* — Innovation Counsel LLP

(57) ABSTRACT

A display device includes a display panel, and the display panel includes a plurality of gate lines, a plurality of data lines, and a plurality of pixels connected to the plurality of data lines and the plurality of gate lines. A data driver provides data signals to the plurality of data lines. A gate driver sequentially generates gate signals corresponding to a start pulse using a clock signal, and provides the gate signals to the plurality of gate lines. A timing controller provides the clock signal and the start pulse to the gate driver. The gate driver compares a data signal provided to a first data line among the plurality of data lines and at least one of the gate signals to generate a feedback signal. The timing controller sets a delay value of the clock signal based on the feedback signal.

20 Claims, 15 Drawing Sheets

(56) References Cited

U.S. PATENT DOCUMENTS

| | | | | |
|---|---|---|---|---|
| 2018/0190192 | A1* | 7/2018 | Kwon | G09G 3/3233 |
| 2020/0273407 | A1* | 8/2020 | Hu | G09G 3/3611 |
| 2020/0394968 | A1* | 12/2020 | Kwon | G09G 3/3291 |
| 2021/0020137 | A1* | 1/2021 | Jang | G09G 3/3688 |
| 2021/0183328 | A1* | 6/2021 | Taniguchi | G09G 3/3677 |
| 2021/0201838 | A1* | 7/2021 | Wei | G02F 1/136286 |

FOREIGN PATENT DOCUMENTS

| | | | |
|---|---|---|---|
| KR | 10-2017-0092163 | A | 8/2017 |
| KR | 10-2018-0018889 | A | 2/2018 |

* cited by examiner

DISPLAY DEVICE AND METHOD OF DRIVING THE SAME

CROSS-REFERENCE TO RELATED APPLICATION

The application claims priority to and the benefit of Korean Patent Application No. 10-2020-0064180, filed May 28, 2020, which is hereby incorporated by reference for all purposes as if fully set forth herein.

BACKGROUND

1. Field of Disclosure

The present disclosure relates to a display device and a method of driving the same. More particularly, the present disclosure relates to a display device capable of improving signal processing of the same, and a method of driving the same.

2. Description of the Related Art

A display device includes data lines, gate lines, and pixels connected to the data lines and the gate lines. Each of the pixels writes or charges a data signal to a storage capacitor in response to a gate signal, and emits light with a luminance corresponding to the charged data signal using a light emitting element.

When the data signal has a resistance-capacitance delay (hereinafter, referred to as an RC delay), a timing at which the data signal is supplied may not match a timing at which the gate signal is supplied. In this case, the data signal is not sufficiently charged in the storage capacitor of a pixel, and the pixel may not emit light at a desired luminance. Thus, there is need to develop a novel display device and a method of driving the same, which can improve luminance of the display device.

SUMMARY

An object of the present disclosure is to provide a display device capable of accurately determining a timing at which a gate signal is supplied corresponding to an RC delay of a data signal, and a method of driving the same.

In order to achieve an object of the present disclosure, a display device according to embodiments of the present disclosure may include: a display panel including gate lines, data lines, and pixels connected to the data lines and the gate lines; a data driver providing data signals to the data lines; a gate driver sequentially generating gate signals corresponding to a start pulse using a clock signal, and providing the gate signals to the gate lines; and a timing controller providing the clock signal and the start pulse to the gate driver. The gate driver may generate a feedback signal by comparing a data signal provided to a first data line among the data lines and at least one of the gate signals, and the timing controller may set a delay value of the clock signal based on the feedback signal.

According to an embodiment, the first data line among the data lines may be the closest to the gate driver.

According to an embodiment, the display device may further include a first connection line adjacent to an n-th gate line (where n is a positive integer) among the gate lines and connected to the first data line, and the gate driver may receive the data signal through the first connection line, and compare an n-th gate signal applied to the n-th gate line and the data signal.

According to an embodiment, a data signal measured at the first connection line may have a resistance-capacitance delay with respect to a data signal measured at an output terminal of the data driver.

According to an embodiment, the gate driver may include a plurality of gate driving circuits. A first gate driving circuit among the gate driving circuits may include: a plurality of stages connected to corresponding first group gate lines among the gate lines, respectively; and a comparator connected to the n-th gate line and the first connection line, respectively. Each of the stages may output the clock signal as a gate signal in response to the start pulse or a carry signal of a previous stage.

According to an embodiment, the n-th gate line among the first group gate lines may be most distant from the data driver.

According to an embodiment, the n-th gate signal may be changed within a first voltage range, the data signal may be changed within a second voltage range, and the second voltage range may be a subset of the first voltage range.

According to an embodiment, the comparator may output the feedback signal having a first logic level when a voltage level of the n-th gate signal is greater than or equal to a voltage level of the data signal, and output the feedback signal having a second logic level when the voltage level of the gate signal is lower than the voltage level of the data signal.

According to an embodiment, the feedback signal may include a pulse, and the pulse may have first and second edges that occur sequentially. The timing controller may determine the delay value of the clock signal based on a change in timing of the second edge of the pulse with respect to the clock signal.

According to an embodiment, the timing controller may include: a clock generator generating a reference clock signal and delayed clock signals in which the reference clock signal is delayed; a delay time calculator calculating the timing of the second edge of the feedback signal; and a delay value determining unit controlling the clock generator to output one of the reference clock signal and the delayed clock signals as the clock signal based on the change in the timing.

According to an embodiment, when changes in timings of the second edge according to the delayed clock signals are maintained within a reference range and then out of the reference range, the delay value determining unit may determine the delay value of the clock signal based on a first timing maintained within the reference range among the timings.

According to an embodiment, the delay value determining unit may select a first delay value of a delayed clock signal corresponding to the first timing, and may respectively set sub-delay values of pulses of the clock signal by interpolating the first delay value based on the n-th gate line.

According to an embodiment, the clock generator may generate the clock signal by delaying pulses of an external clock signal based on the sub-delay values, respectively.

According to an embodiment, the delay value determining unit may select the first delay value of the delayed clock signal corresponding to the first timing, and determine a period of the clock signal based on the first delay value.

According to an embodiment, the timing controller may determine a first delay value in a first section of the clock signal corresponding to the first gate driving circuit, and determine a second delay value in a second section of the clock signal corresponding to a second gate driving circuit among the gate driving circuits based on the first delay value.

According to an embodiment, the gate driving circuits may be interconnected through one feedback line, and connected to the timing controller through the feedback line.

According to an embodiment, the clock signal may include a plurality of sub-clock signals each provided to corresponding gate driving circuit among the gate driving circuits.

In order to achieve an object of the present disclosure, a method of driving a display device according to embodiments of the present disclosure may include: providing data signals to the data lines through a data driver, and sequentially providing a clock signal as a gate signal to the gate lines through a gate driver; generating a feedback signal by comparing a data signal provided to a first data line among the data lines and at least one of gate signals through the gate driver; calculating a delay time of the feedback signal based on the clock signal by a timing controller; and setting a delay value of the clock signal based on a change in the delay time of the feedback signal.

According to an embodiment, the setting the delay value of the clock signal may include: determining whether the change in the delay time is out of a reference range; increasing the delay value for delaying the clock signal when the change in the delay time is within the reference range; and repeating sequentially providing the clock signal as the gate signal to the gate lines, and generating the feedback signal.

According to an embodiment, the setting the delay value of the clock signal may further include: respectively setting sub-delay values of pulses of the clock signal based on a previous delay value of the clock signal when the change in the delay time is out of the reference range.

BRIEF DESCRIPTION OF THE DRAWINGS

The accompanying drawings, which are included to provide a further understanding of the inventive concepts, and are incorporated in and constitute a part of this specification, illustrate exemplary embodiments of the inventive concepts, and, together with the description, serve to explain principles of the inventive concepts.

DETAILED DESCRIPTION

Figure 1:
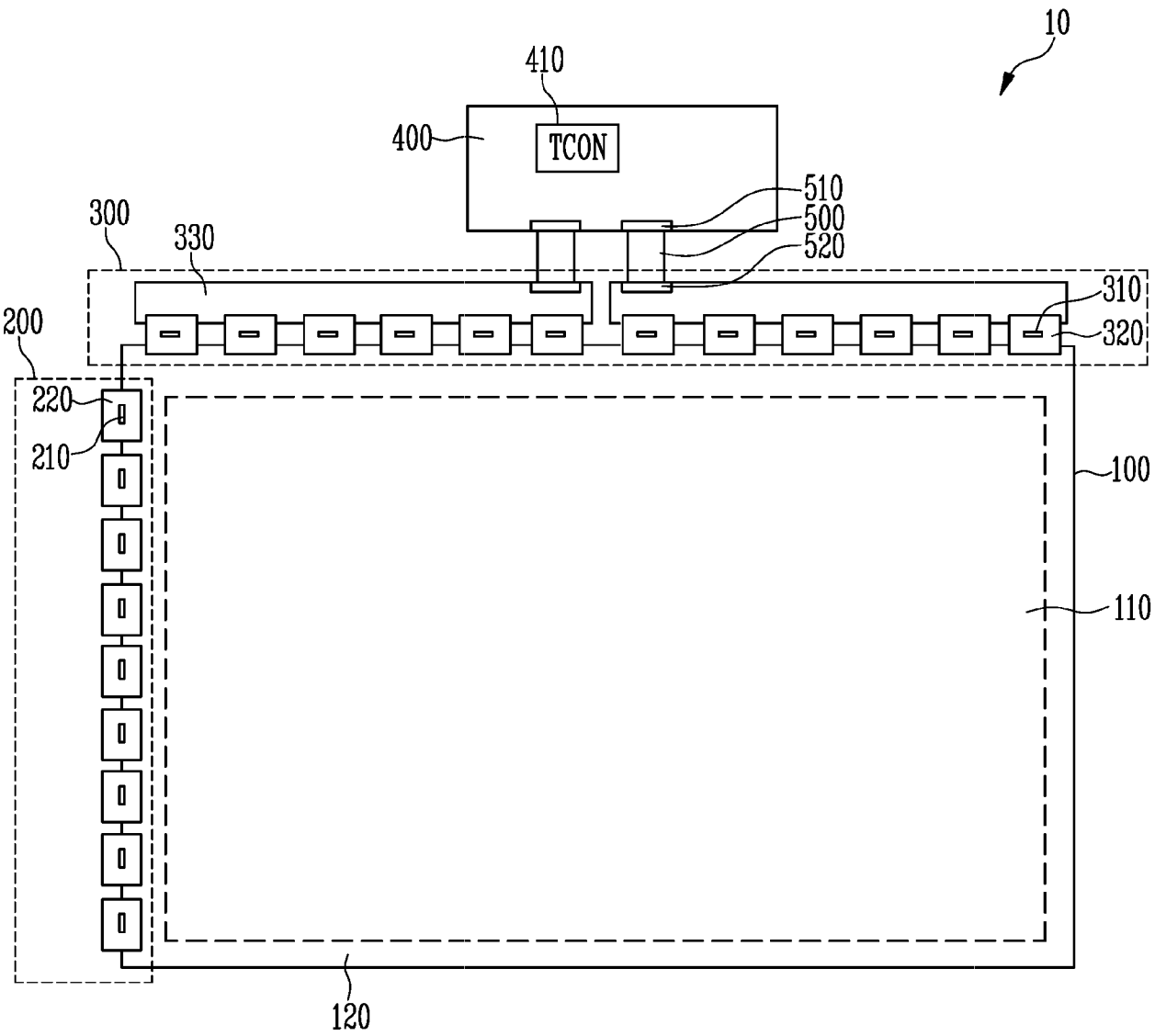
FIG. 1 is a diagram illustrating a display device according to embodiments of the present disclosure.

Hereinafter, various embodiments of the present disclosure are described in detail with reference to the accompanying drawings so that those skilled in the art may easily practice the present disclosure. The present disclosure may be implemented in various different forms and is not limited to the embodiments described in the present specification.

In order to clearly describe the present disclosure, parts irrelevant to the description are omitted. The same or similar components are denoted by the same reference numerals throughout the specification. Therefore, the reference numerals described above may be used in other drawings.

FIG. 1 is a diagram illustrating a display device according to embodiments of the present disclosure. As one of embodiments to which the present disclosure can be applied, FIG. 1 shows a display device including a plurality of gate driver ICs and a plurality of data driver ICs. However, the present disclosure is not limited thereto. For example, the present disclosure may also be applied to a display device including one gate driver IC and one data driver IC.

Figure 2:
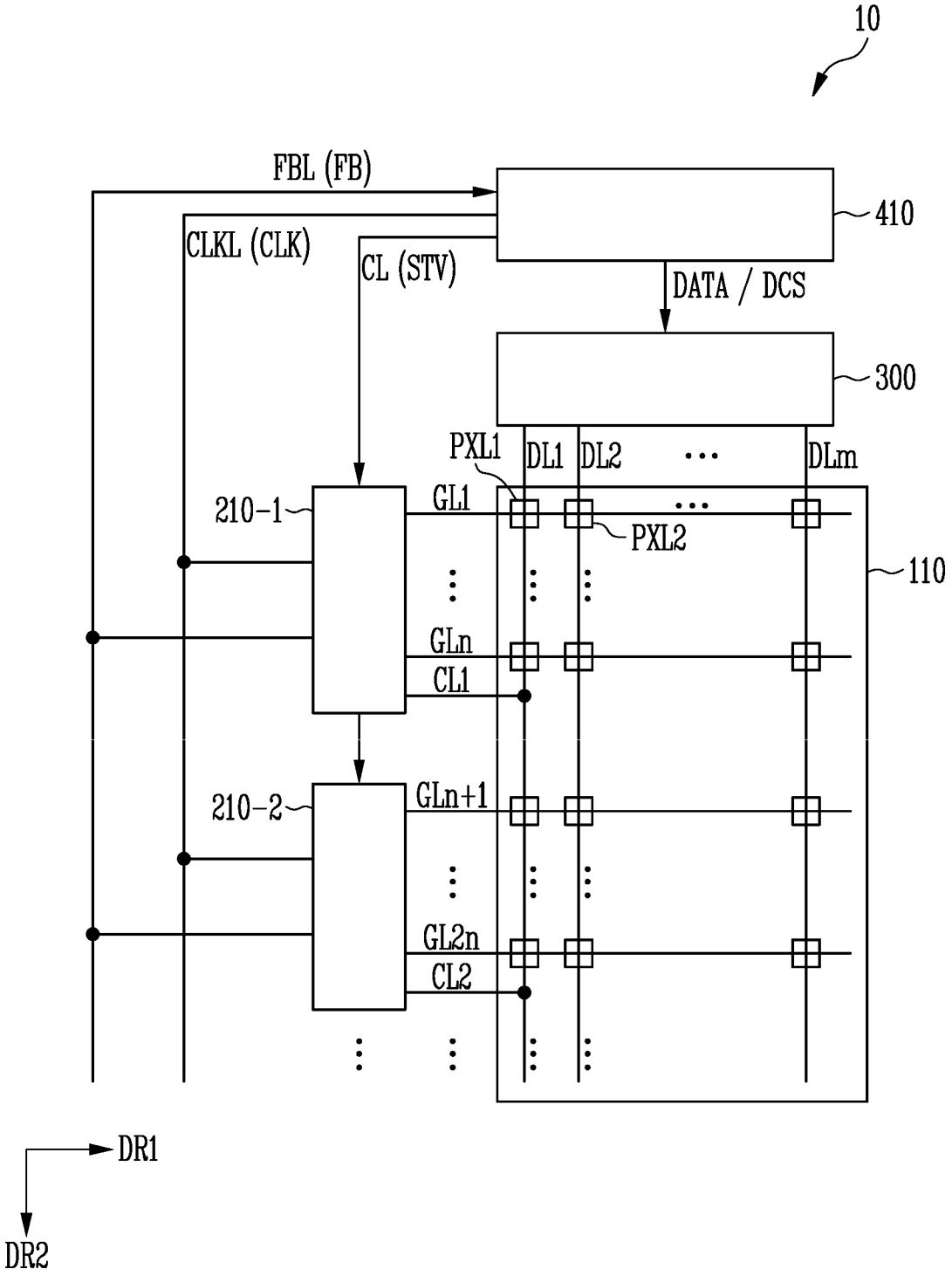
FIG. 2 is a diagram illustrating an example of the display device of FIG. 1.

Referring to FIGS. 1 and 2, a display device 10 may include a display panel 100 (or display unit), a gate driver 200, a data driver 300 (or source driver), and a timing controller (TCON) 410. The gate driver 200 may include a gate driver integrated circuit 210 (hereinafter, the integrated circuit is referred to as "IC") (or gate driving circuit), and the data driver 300 may include a data driver IC 310 (source driver IC, or data driving circuit).

The display panel 100 may include a display area 110 displaying an image and a non-display area 120 outside the display area 110. The display panel 100 may include gate lines, data lines, and pixels. The specific configuration of the display panel 100 will be described later with reference to FIG. 2.

The timing controller 410 may control the gate driver IC 210 and the data driver IC 310. The timing controller 410 may receive a control signal (for example, a control signal including an external clock signal) from an external source (not shown) and generate a gate control signal and a data control signal based on the control signal. The timing controller 410 may provide the gate control signal to the gate driver IC 210 and the data control signal to the data driver IC 310.

In addition, the timing controller 410 may rearrange input data (or raw image data) provided from the external source (for example, a graphic processor) to generate image data, and provide the image data to the data driver IC 310. The timing controller 410 may be mounted on a control board 400, or the timing controller 410 may be integrated with the control board 400.

The gate driver IC 210 and the data driver IC 310 may drive the display panel 100.

The gate driver IC 210 may receive the gate control signal from the timing controller 410 and generate gate signals based on the gate control signal. The gate driver IC 210 may provide the gate signals to the display panel 100.

The gate driver IC 210 may be mounted on a gate driving circuit film 220, and connected to the timing controller 410 mounted on the control board 400 via at least one data driving circuit film 320 (or source driving circuit film), a data printed circuit board 330 (or source printed circuit board) and/or a cable 500 (or flexible circuit board). However, the present disclosure is not limited thereto. For example, the gate driver IC 210 may be formed on the display panel 100 together with the pixels.

The data driver IC 310 may receive the data control signal and the image data from the timing controller 410 and generate data signals corresponding to the image data. The data driver IC 310 may provide the data signals to the display panel 100. The data driver IC 310 may be mounted on the data driving circuit film 320 and connected to the timing controller 410 via at least one data printed circuit board 330 and/or the cable 500.

The cable 500 may electrically connect the control board 400 and at least one data printed circuit board 330 through upper and lower connectors 510 and 520. Here, the cable 500 may refer to a device having wirings capable of electrically connecting the control board 400 and the data printed circuit board 330. For example, the cable 500 may be implemented as a flexible circuit board.

FIG. 2 is a diagram illustrating an example of the display device of FIG. 1. As a simplified configuration of the display device 10 shown in FIG. 1, FIG. 2 briefly shows first and second gate driver ICs 210-1 and 210-2 among the gate driver ICs shown in FIG. 1.

Referring to FIGS. 1 and 2, the display area 110 (or the display panel 100) may include gate lines from GL1 to GLn and from GLn+1 to GL2*n*, connection lines CL1 and CL2, data lines DL1, DL2, . . . , and DLm, and pixels PXL1 and PXL2, where n and m are positive integers.

The gate lines from GL1 to GLn and from GLn+1 to GL2*n* may extend in a first direction DR1 and may be sequentially arranged along a second direction DR2.

The gate lines from GL1 to GLn and from GLn+1 to GL2*n* may be divided into a plurality of groups (or gate line groups) corresponding to the first and second gate driver ICs 210-1 and 210-2. For example, the gate lines from GL1 to GLn and from GLn+1 to GL2*n* may include first group gate lines from GL1 to GLn (or a first gate line group) and second group gate lines from GLn+1 to GL2*n* (or a second gate line group). The first group gate lines from GL1 to GLn may include first to n-th gate lines from GL1 to GLn, and may be connected to the first gate driver IC 210-1. The second group gate lines from GLn+1 to GL2*n* may include (n+1)th to 2n-th gate lines from GLn+1 to GL2*n* and may be connected to the second gate driver IC 210-2. For example, as shown in FIG. 1, when the display device 10 includes nine gate driver ICs, the gate lines from GL1 to GLn and from GLn+1 to GL2*n* may include nine gate line groups, each corresponding to the nine gate driver ICs. Each of the nine gate line groups may include n gate lines. The number of gate lines included in each of the gate line groups may be different for each gate line group.

The data lines DL1, DL2, . . . , and DLm may extend in the second direction DR2 and may be sequentially arranged along the first direction DR1.

In an embodiment, a first data line DL1 among the data lines DL1, DL2, . . . , and DLm may be disposed closest to the first and second gate driver ICs 210-1 and 210-2. As will be described later, while the display device 10 (or the timing controller 410) sets a clock signal CLK (or delay value or period of the clock signal) for the first and second gate driver ICs 210-1 and 210-2, for example, in a clock setting section, a test signal (for example, a data signal corresponding to a white color) may be provided to the first data line DL1.

In an embodiment, the first data line DL1 may be a dummy line. In this case, while an image is displayed on the display area 110, for example, in a display section, a valid data signal may not be provided to the first data line DL1 or a black data signal corresponding to a black color may be provided to the first data line DL1. Valid data signals may be provided to second to m-th data lines DL2 to DLm.

The connection lines CL1 and CL2 may be disposed between the gate lines from GL1 to GLn and from GLn+1 to GL2*n*, and extended in the first direction DR1. Furthermore, the connection lines CL1 and CL2 may connect the first and second gate driver ICs 210-1 and 210-2 and the first data line DL1, respectively.

For example, a first connection line CL1 may be disposed between the n-th gate line GLn and the (n+1)th gate line GLn+1 or adjacent to the n-th gate line GLn. Furthermore, the first connection line CL1 may extend in the first direction DR1 and connect the first gate driver IC 210-1 and the first data line DL1. In this case, the first gate driver IC 210-1 may receive a data signal (for example, a data signal applied to the first data line DL1) through the first connection line CL1. Similarly, a second connection line CL2 may be disposed adjacent to the 2n-th gate line GL2*n*, and may connect the second gate driver IC 210-2 and the first data line DL1. In this case, the second gate driver IC 210-2 may receive the data signal (for example, the data signal applied to the first data line DL1) through the second connection line CL2.

Meanwhile, in FIG. 2, the first connection line CL1 is shown as being positioned adjacent to the n-th gate line GLn, which is the last gate line among the first to n-th gate lines from GL1 to GLn, but the position of the first connection line CL1 is not limited thereto. For example, the first connection line CL1 may be positioned adjacent to any one of the first to n-th gate lines from GL1 to GLn (for example, a middle order gate line among the first to n-th gate lines from GL1 to GLn). However, as will be described later, as the position of the first connection line CL1 is further away from the data driver 300 (that is, a point where the data signal is supplied), an RC delay of the data signal can be measured more accurately. Accordingly, more optimized clock signal CLK may be set for the first gate driver IC 210-1.

The pixels PXL1 and PXL2 may be positioned in regions where the gate lines from GL1 to GLn and from GLn+1 to GL2*n* and the data lines DL1, DL2, . . . , and DLm are intersect, or regions partitioned by the gate lines from GL1 to GLn and from GLn+1 to GL2*n* and data lines DL1, DL2, . . . , and DLm.

Each of the pixels PXL1 and PXL2 may be connected to a corresponding gate line among the gate lines from GL1 to GLn and from GLn+1 to GL2*n* and a corresponding data line among the data lines DL1, DL2, . . . , and DLm, and may emit light with a luminance corresponding to the data signal (that is, the data signal provided through the corresponding data line) in response to a gate signal (that is, a gate signal provided through the corresponding gate line). To this end, each of the pixels PXL1 and PXL2 may include at least one light emitting element, a switching transistor transmitting the data signal in response to the gate signal, a storage capacitor storing the data signal transmitted through the switching transistor, and a driving transistor providing a driving current to at least one light emitting element in response to the stored data signal. Here, the light emitting element may be an organic light emitting element or an inorganic light emitting element.

In an embodiment, when the first data line DL1 is the dummy line, first pixels PXL1 connected to the first data line DL1 may be dummy pixels. For example, each of the first pixels PXL1 may include only a pixel circuit such as the switching transistor, the driving transistor, and the like, and may not include the light emitting element. Meanwhile, second pixels PXL2 which are connected to the second to m-th data lines from DL2 to DLm may be effective pixels. Each of the second pixels PXL2 may include the switching transistor, the driving transistor, the storage capacitor, and the light emitting element as described above, and emit light with a luminance corresponding the data signal.

The first gate driver IC 210-1 may receive the clock signal CLK through a clock line CLKL from the timing controller 410, and a start pulse STV (or start signal) through a control line CL. The first gate driver IC 210-1 may sequentially generate the gate signals corresponding to the start pulse STV using the clock signal CLK, and sequentially provide the gate signals to the first to n-th gate lines from GL1 to GLn. For example, the first gate driver IC 210-1 may be implemented as a shift register (or stages) for sequentially shifting and outputting the start pulse STV.

In an embodiment, the first gate driver IC 210-1 may compare an n-th gate signal (that is, the gate signal applied to the n-th gate line GLn) and the data signal (that is, the data signal provided through the first connection line CL1) to generate a feedback signal FB. The feedback signal FB may be provided to the timing controller 410 through a feedback line FBL.

The specific configuration and operation of the first gate driver IC 210-1 will be described later with reference to FIG. 4.

Similarly, the second gate driver IC 210-2 may receive the clock signal CLK from the timing controller 410 through the clock line CLKL, and receive a carry signal (for example, a carry signal corresponding to or the same as the gate signal provided to the n-th gate line GLn) from the first gate driver IC 210-1. Furthermore, the second gate driver IC 210-2 may sequentially generate the gate signals corresponding to the carry signal using the clock signal CLK, and sequentially provide the gate signals to the (n+1)th to 2n-th gate lines from GLn+1 to GL2*n*. In addition, the second gate driver IC 210-2 may compare a 2n-th gate signal (that is, the gate signal applied to the 2n-th gate line GL2*n*) and the data signal (that is, the data signal provided through the second connection line CL2) to generate the feedback signal FB. The feedback signal FB of the second gate driver IC 210-2 may be provided to the timing controller 410 through the feedback line FBL through which the feedback signal FB of the first gate driver IC 210-1 is transmitted.

The data driver 300 may generate the data signals (or data voltages) based on image data DATA and the data control signal DCS provided from the timing controller 410, and provide the data signals to the data lines DL1, DL2, . . . , and DLm.

In an embodiment, the data driver 300 may provide the test signal to the first data line DL1 in a setting section of the display device 10. For example, the test signal may include the data signal for the pixels connected to the n-th gate line GLn. For example, the test signal may include the data signal corresponding to the white color. As described above, since the first gate driver IC 210-1 compares the n-th gate signal (that is, the gate signal applied to the n-th gate line GLn) and the data signal, the test signal may include the data signal corresponding to a time point when the n-th gate signal is supplied. Similarly, the test signal may include the data signal for the pixels connected to the 2n-th gate line GL2*n*.

The timing controller 410 may generate the clock signal CLK, the start pulse STV, the data control signal DCS, and the image data DATA.

In embodiments, the timing controller 410 may generate the clock signal CLK based on the external clock signal provided from the outside, but adjust or change a delay value (for example, a time for delaying the external clock signal) of the clock signal CLK based on the feedback signal FB. In other words, the timing controller 410 may change a period of the clock signal CLK.

For example, the timing controller 410 may sequentially receive feedback signals FB corresponding to delayed clock signals and determine the delay value (or period) of the clock signal CLK based on a change in the feedback signals FB while providing a plurality of delayed clock signals to the gate driver ICs 210-1 and 210-2 in the clock setting section of the display device 10. Here, the plurality of delayed clock signals may have the same waveform as the external clock signal, but may have different phases. The feedback signal FB may be generated by comparison of the gate signal and the data signal, and may contain or reflect delay information (for example, delayed time information) of the data signal based on the gate signal. This is because the data signal has a relatively large RC delay while overlapping with other components (for example, transistors, power source lines, and the like) in the display area 110, while the gate signal applied to the gate line that does not overlap with the other components (in particular, the gate signals at output terminals of the gate driver ICs 210-1 and 210-2) has a relatively small RC delay.

Accordingly, the timing controller 410 may determine the delay value (or period) of the clock signal CLK based on the change in the feedback signal FB, for example, a section (and the delayed clock signal corresponding to the section) in which the change in the feedback signal FB has a minimum value or is maintained at the minimum value. For example, the timing controller 410 may compare the feedback signal FB and a reference clock signal (that is, the delayed clock signal based on the generation of the feedback signal FB) to extract the delay information of the data signal, select or determine the delayed clock signal that maintains the delay information at the minimum value, and set the clock signal CLK based on the delay value of the delayed clock signal.

The configuration in which the timing controller 410 sets the delay value (or period) of the clock signal CLK will be described later with reference to FIGS. 7, 8, 9A, 9B, 10A, and 10B.

As described with reference to FIG. 2, the first gate driver IC 210-1 (or gate driver 200 shown in FIG. 1) may receive the data signal (or test signal) of the first data line DL1 through the first connection line CL1, and compare the n-th gate signal applied to the n-th gate line GLn adjacent to the first connection line CL1 and the data signal to generate the feedback signal FB (that is, a signal containing the delay information of the data signal). The timing controller 410 may set the clock signal CLK (for example, the clock signal that allows the gate signal to be provided to the gate line at a timing coincident with the data signal having the RC delay) based on the feedback signal FB. That is, the display device 10 may detect the RC delay of the data signal (or a section in which a peak value of the data signal is supplied), and determine a timing at which the gate signal is supplied in response to the delay of the data signal. Therefore, the pixels (for example, the second pixel PXL2) may charge the data signal in response to the gate signal to emit light with a desired luminance. Accordingly, the quality of the image displayed on the display area 110 can be improved.

Figure 3:
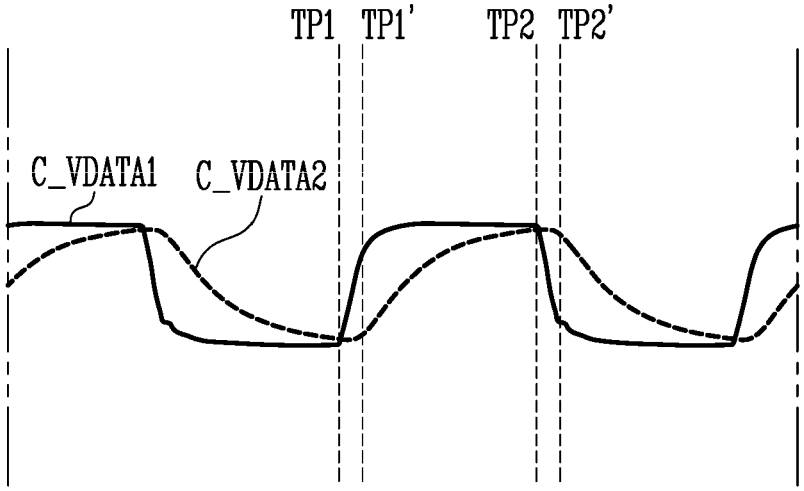
FIG. 3 is a waveform diagram illustrating data signals measured at a first data line included in the display device of FIG. 2.

FIG. 3 is a waveform diagram illustrating data signals measured at a first data line included in the display device of FIG. 2.

Referring to FIGS. 2 and 3, a first curve C_VDATA1 may represent the data signal measured at one end of the first data line DL1 (for example, one end connected to an output terminal of the data driver 300) or a first point of the first data line DL1 overlapping with the first gate line GL1. A second curve C_VDATA2 may represent the data signal measured at a second point of the first data line DL1 connected to the second connection line CL2 or the other end of the first data line DL1.

According to the first curve C_VDATA1, the data signal at the first point of the first data line DL1 may be changed from a first voltage level (for example, a voltage level corresponding to the black color) to a second voltage level (for example, a voltage level corresponding to the white color) at a first time point TP1, maintained at the second voltage level in a section between the first time point TP1 and a second time point TP2, and changed from the second voltage level to the first voltage level at the second time point TP2.

Meanwhile, according to the second curve C_VDATA2, the data signal at the second point of the first data line DL1 may start to be changed from the first voltage level to the second voltage level at a first time point TP1', and may be changed from the second voltage level to the first voltage level at a second time point TP2' (or a third voltage level similar to the second voltage level but lower than the second voltage level). In this case, the data signal at the second point of the first data line DL1 may maintain a relatively gentle slope in a section between the first time point TP1' and the second time point TP2'. Here, the first time point TP1' may be a time point delayed by a predetermined time from the first time point TP1. Similarly, the second time point TP2' may be a time point delayed by a predetermined time from the second time point TP2.

The first data line DL1 (or data lines DL1, DL2, . . . , and DLm) may overlap the gate lines GL1 to GLn and GLn+1 to GL2*n*, the power source lines, light emitting elements, and the like in the display area 110, and have a capacitance formed by these relationships. The RC delay may occur in the data signal due to the resistance of the first data line DL1 and the capacitance. Accordingly, the data signal at the second point relatively spaced from the data driver 300 may have the RC delay based on the data signal at the first point. As the distance from the data driver 300 increases, the RC delay of the data signal may be increased. In addition, as the display device 10 becomes large and high-resolution, the resistance and capacitance of the first data line DL1 (or data lines DL1, DL2, . . . , and DLm) may increase, and the RC delay of the data signal may further increase.

Meanwhile, the clock line CLKL may be disposed outside the display area 110 (that is, in the non-display area 120 shown in FIG. 1) and an area the clock line CLKL overlapped with other component (for example, signal lines) may be small. Accordingly, the clock signal CLK transmitted through the clock line CLKL and the gate signals output based on the clock signal (in particular, the gate signal at a point overlapping the first data line DL1) may have little RC delay. Accordingly, a section in which the data signal has the peak value at the second point (that is, the data signal having a relatively large RC delay) may not coincide with the time point (or section) in which the gate signal (or gate pulse) is supplied, and the data signal may not be sufficiently charged in the pixel corresponding to the second point.

Accordingly, the display device 10 may detect the section in which the data signal (that is, the data signal having the RC delay) has the peak value using the feedback signal FB, and adjust or set the delay value (or period) of the clock signal CLK so that the gate signal may be supplied in the section.

Figure 4:
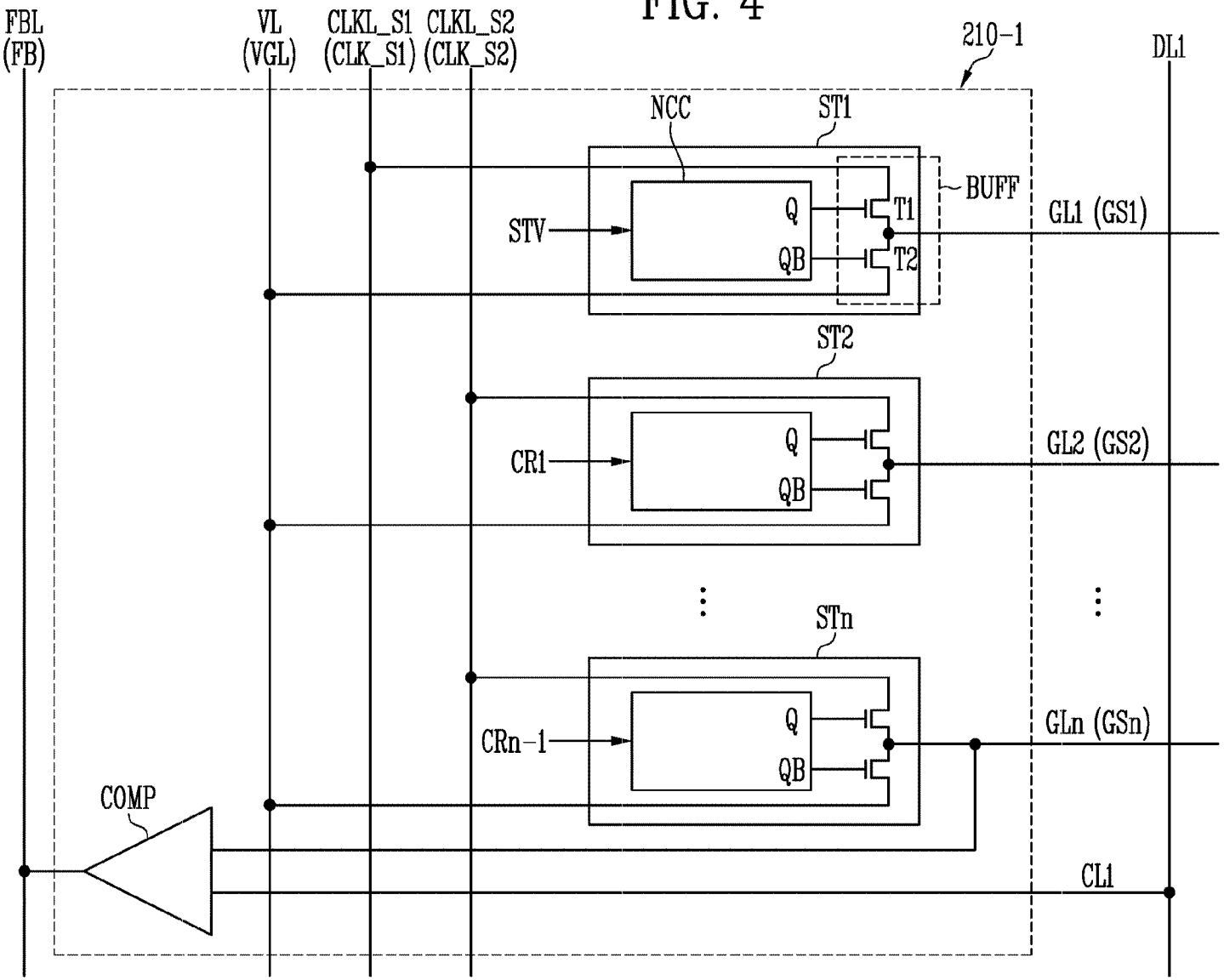
FIG. 4 is a diagram illustrating an example of a first gate driver IC included in the display device of FIG. 2.
Figure 5:
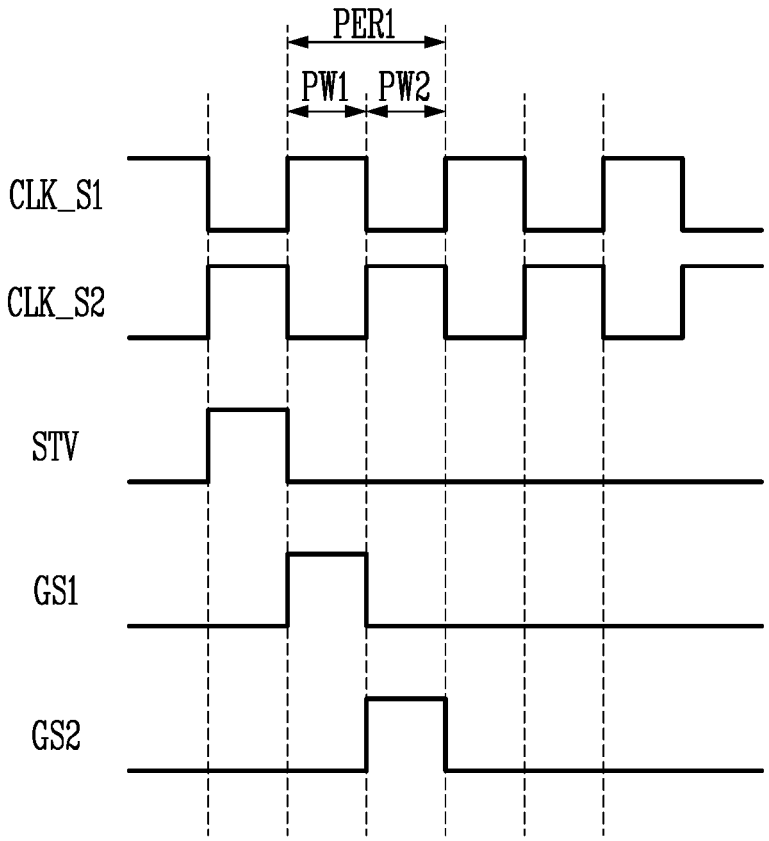
FIG. 5 is a waveform diagram for explaining operations of stages included in the first gate driver IC of FIG. 4.

FIG. 4 is a diagram illustrating an example of a first gate driver IC included in the display device of FIG. 2. The first gate driver IC 210-1 and the second gate driver IC 210-2 shown in FIG. 2 (and the gate driver ICs shown in FIG. 1) are substantially equal except for the locations where they are disposed. Therefore, the first gate driver IC 210-1 that can cover the first gate driver IC 210-1 and the second gate driver IC 210-2 will be described. FIG. 5 is a waveform diagram for explaining operations of stages included in the first gate driver IC of FIG. 4.

Firstly, referring to FIGS. 2 and 4, a first gate driver IC 210-1 (or a first gate driving circuit) may include stages ST1, ST2, . . . , and STn (or stage circuits) and a comparator COMP.

The stages ST1, ST2, . . . , and STn may be connected to a first sub-clock line CLKL_S1, a second sub-clock line CLKL_S2, and a power source line VL. The stages ST1, ST2, . . . , and STn may receive a first sub-clock signal CLK_S1 provided through the first sub-clock line CLKL_S1, a second sub-clock signal CLK_S2 provided through the second sub-clock line CLKL_S2, and a voltage of a logic low level VGL (or gate-off level) provided through the power source line VL as input signals. The first sub-clock line CLKL_S1 and the second sub-clock line CLKL_S2 may be included in the clock line CLKL described with reference to FIG. 2. The second sub-clock signal CLK_S2 may have the same waveform as the first sub-clock signal CLK_S1, but may have a different phase from the first sub-clock signal CLK_S1.

In addition, the stages ST1, ST2, . . . , and STn may be connected to the first to n-th gate lines GL1, GL2, . . . , and GLn (or the first group gate lines), respectively, and sequentially provide or output the first to n-th gate signals GS1, GS2, . . . , and GSn to the first to n-th gate lines GL1, GL2, . . . , and GLn.

Each of the stages ST1, ST2, . . . , and STn may output the clock signal as the gate signal in response to the start pulse STV or the carry signal of a previous stage.

For example, a first stage ST1 may include a node control circuit NCC and a buffer BUFF. The node control circuit NCC of the first stage ST1 may control a voltage of a first node Q and a voltage of a second node QB based on the start pulse STV. The buffer BUFF of the first stage ST1 may include a first transistor T1 and a second transistor T2. The first transistor T1 and the second transistor T2 may be N-type transistors, but the present disclosure is not limited thereto. In some cases, the first transistor T1 and the second transistor T2 may be implemented as P-type transistors.

In the first stage ST1, a first electrode of the first transistor T1 may be connected to the first sub-clock line CLKL_S1, a second electrode of the first transistor T1 may be connected to the first gate line GL1, and a gate electrode of the first transistor T1 may be connected to the first node Q. A first electrode of the second transistor T2 may be connected to the first gate line GL1, a second electrode of the second transistor T2 may be connected to the power source line VL, and a gate electrode of the second transistor T2 may be connected to the second node QB.

In the first stage ST1, when the node control circuit NCC adjusts a voltage of the first node Q to a logic high level in response to the start pulse STV, the first transistor T1 may be turned on, and the first sub-clock signal CLK_S1 may be provided to the first gate line GL1 as the first gate signal GS1. In the first stage ST1, when the start pulse STV is not applied, the node control circuit NCC may maintain a voltage of the second node QB at the logic high level. In this case, the second transistor T2 may be turned on, and the first gate signal GS1 may be maintained to have the logic low level VGL, or the logic low level VGL may be applied to the first gate line GL1.

The circuit configurations of second stage ST2 to n-th stage STn may be substantially equal or similar to the circuit configuration of the first stage ST1, and thus duplicate descriptions will be omitted.

The second stage ST2 may control the voltage of the first node Q based on a first carry signal CR1 and output the second sub-clock signal CLK_S2 provided through the second sub-clock line CLKL_S2 to the second gate line GL2 as the second gate signal GS2. Here, the first carry signal CR1 may be provided from the first stage ST1 (that is, the previous stage of the second stage ST2) and may have the same waveform and phase as the first gate signal GS1. For example, the first stage ST1 may minor the first gate signal GS1 and output the first carry signal CR1.

Similarly, the n-th stage STn may control the voltage of the first node Q based on an (n−1)th carry signal CRn−1, and output the second sub-clock signal CLK_S2 provided through the second sub-clock line CLKL_S2 to the n-th gate line GLn as the n-th gate signal GSn.

Referring to FIG. 5, the first sub-clock signal CLK_S1 may have a first period PER1, and may have a logic high level and a logic low level that alternately repeated within the first period PER1. For example, a section in which the first sub-clock signal CLK_S1 has the logic high level may have a first width PW1, and a section in which the first sub-clock signal CLK_S1 has the logic low level may have a second width PW2. The first width PW1 and the second width PW2 may be the same, and may have one horizontal time. However, the present disclosure is not limited thereto, for example, the second width PW2 may be greater than the first width PW1.

The start pulse STV may include a logic high level pulse.

In this case, the node control circuit NCC of the first stage ST1 may change the voltage of the first node Q to the logic high level, and maintain the voltage of the first node Q at the logic high level during one horizontal time after the start pulse STV is applied. In this case, the first stage ST1 may output the first sub-clock signal CLK_S1 (that is, one pulse of the first sub-clock signal CLK_S1) having the logic high level as the first gate signal GS1.

Similarly, the second stage ST2 may change the voltage of the first node Q to the logic high level in response to the first carry signal CR1 (that is, the carry signal corresponding to the first gate signal GS1), maintain the voltage of the first node Q at the logic high level during one horizontal time after the first carry signal CR1 is applied, and output the second sub-clock signal CLK_S2 (that is, one pulse of the second sub-clock signals CLK_S2) having the logic high level as the second gate signal GS2. In this way, the stages ST1, ST2, . . . , and STn may sequentially output the gate signals corresponding to the start pulse STV.

Meanwhile, in FIG. 5, the start pulse STV and the gate signals GS1 and GS2 are shown to have the logic high level. However, this is an example, and the start pulse STV and the gate signals GS1 and GS2 are not limited thereto. For example, when the pixels PXL1 and PXL2 (refer to FIG. 2) include the P-type transistors rather than the N-type transistors, the start pulse STV and the gate signals GS1 and GS2 may have the logic low level. That is, voltage levels (or waveforms) of the start pulse STV and the gate signals GS1 and GS2 may be changed according to the type of the transistors in the pixels PXL1 and PXL2 (refer to FIG. 2).

Referring back to FIG. 4, the comparator COMP may be connected to the n-th gate line GLn and the first data line DL1, respectively, and receive the n-th gate signal GSn provided through the n-th gate line GLn and the data signal provided through the first data line DL1 as input signals.

The comparator COMP may compare the n-th gate signal GSn and the data signal, and output a comparison result as the feedback signal FB. For example, the comparator COMP may consist of a logic circuit including an amplifier. For example, when a voltage of the n-th gate signal GSn is greater than or equal to a voltage of the data signal, the comparator COMP may output a first logic value (for example, 1) (or the feedback signal FB having a first logic level). In addition, when the voltage of the n-th gate signal GSn is smaller than the voltage of the data signal, the comparator COMP may output a second logic value (for example, 0) (or the feedback signal FB having a second logic level).

Figure 6:
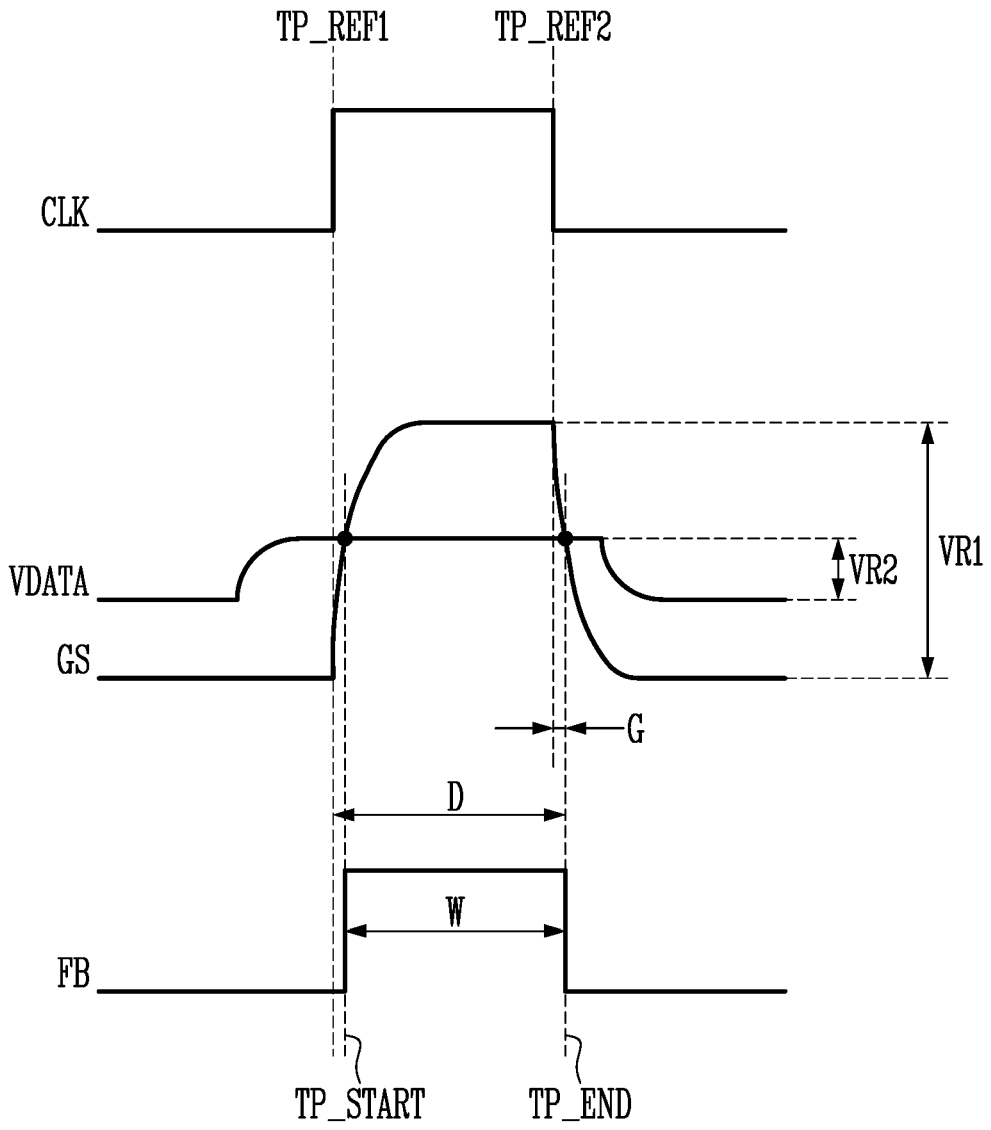
FIG. 6 is a waveform diagram for explaining an operation of a comparator included in the first gate driver IC of FIG. 4.

FIG. 6 may be referenced to describe an operation of the comparator COMP.

FIG. 6 is a waveform diagram for explaining an operation of a comparator included in the first gate driver IC of FIG. 4.

Referring to FIGS. 4, 5 and 6, the clock signal CLK (for example, the second sub-clock signal CLK_S2) may be changed from the logic low level to the logic high level at a first reference time point TP_REF1, and from the logic high level to the logic low level at a second reference time point TP_REF2.

In this case, at least one of the stages from ST1 to STn may output the gate signal GS using the clock signal CLK. For example, the n-th stage STn may output a pulse of the second sub-clock signal CLK_S2 to the n-th gate line GLn as the n-th gate signal GSn.

The gate signal GS may start to be changed from the logic low level to the logic high level at the first reference time point TP_REF1, and may have the logic high level at a time point elapsed by a predetermined time from the first reference time point TP_REF1. Furthermore, the gate signal GS may start to be changed from the logic high level to the logic low level at the second reference time point TP_REF2, and may have the logic low level after a predetermined time has elapsed from the second reference time point TP_REF2. The gate signal GS may have some response delay due to circuit elements of the stages, but the magnitude of the delay is relatively small and may be ignored.

The data signal VDATA may be changed from the first voltage level (for example, the voltage level corresponding to the black color) to the second voltage level (for example, the voltage level corresponding to the white color) corresponding to the gate signal GS. Meanwhile, the data signal VDATA (for example, the test signal) may have a waveform substantially the same as the first curve C_VDATA1 described with reference to FIG. 3. Therefore, duplicate descriptions will be omitted.

For example, the data signal VDATA may be changed from the first voltage level to the second voltage level before the first reference time point TP_REF1, and may have the second voltage level in a section between the first reference time point TP_REF1 and the second reference time point TP_REF2. Furthermore, the data signal VDATA may be changed from the second voltage level to the first voltage level after the second reference time point TP_REF2.

For reference, the data signal VDATA may be changed within a second voltage range VR2. For example, the magnitude of the second voltage range VR2 (that is, a difference between the second voltage level and the first voltage level) may be about 15V. The gate signal GS may be changed within a first voltage range VR1. For example, the magnitude of the first voltage range VR1 (that is, a difference between the logic high level and the logic low level) may be about 30V. The second voltage range VR2 may be included in the first voltage range VR1 and may be a subset of the first voltage range VR1. That is, the gate signal GS for switching (that is, complete turn-on and turn-off) the transistors in the pixels PXL1 and PXL2 (refer to FIG. 2) may have a voltage range greater than the data signal VDATA for controlling the amount of driving current flowing through the transistors. Accordingly, the gate driver 200 (refer to FIG. 1) (or gate driver ICs 210-1 and 210-2 shown in FIG. 2) may receive the data signal VDATA within the first voltage range VR1 and generate the feedback signal FB containing the delay information of the data signal VDATA.

Meanwhile, the comparator COMP may compare the gate signal GS and the data signal VDATA to generate the feedback signal FB. That is, the feedback signal FB may represent the comparison result of the gate signal GS and the data signal VDATA.

As shown in FIG. 6, when a voltage level of the gate signal GS is lower than a voltage level of the data signal VDATA, the feedback signal FB may have the logic low level. When the voltage level of the gate signal GS is greater than or equal to the voltage level of the data signal VDATA, the feedback signal FB may have the logic high level. Since the first voltage range VR1 of the gate signal GS is greater than the second voltage range VR2 of the data signal VDATA, the gate signal GS (or gate pulse) may have the same voltage as the data signal VDATA at two points (or time points), and the feedback signal FB may have the logic high level between the two points.

For example, the voltage level of the gate signal GS and the voltage level of the data signal VDATA may be equal at a start time point TP_START, and the voltage level of the gate signal GS and the voltage level of the data signal VDATA may be the same at an end time point TP_END. Accordingly, the feedback signal FB may have a rising edge (or first edge) at the start time point TP_START, and a falling edge (or second edge) at the end time point TP_END. The feedback signal FB may have the logic high level in a section between the start time point TP_START and the end time point TP_END.

When the data signal VDATA has the RC delay, a waveform of the data signal VDATA may be changed. Therefore, the start time point TP_START and/or the end time point TP_END may be changed based on the first reference time point TP_REF1 and/or the second reference time point TP_REF2.

For example, a time difference D between the first reference time point TP_REF1 and the end time point TP_END may be changed according to the RC delay of the data signal VDATA. Accordingly, the timing controller 410 (refer to FIG. 2) may extract the delay information of the data signal VDATA based on the time difference D.

In addition, an interval G between the second reference time point TP_REF2 and the end time point TP_END may also be changed according to the RC delay of the data signal VDATA. In this case, the timing controller 410 (refer to FIG. 2) may extract the delay information of the data signal VDATA based on the interval G.

Meanwhile, a pulse width W of the feedback signal FB may also be changed according to the RC delay of the data signal VDATA. In this case, the timing controller 410 (refer to FIG. 2) may extract the delay information of the data signal VDATA based on the pulse width W of the feedback signal FB.

As will be described later, since the gate signal GS must be provided to the gate line while the data signal VDATA has the peak value, the falling edge (that is, the end time point TP_END) of the feedback signal FB may be a main factor determining the timing (that is, the delay value of the clock signal CLK) at which the gate signal GS is supplied. Accordingly, the timing controller 410 (refer to FIG. 2) may set the clock signal CLK (or the delay value of the clock signal CLK) based on the falling edge (that is, the end time point TP_END) of the feedback signal FB.

As described with reference to FIG. 6, the comparator COMP may compare the gate signal GS and the data signal VDATA to generate the feedback signal FB, and the falling edge (that is, the end time point TP_END) of the feedback signal FB may contain the delay information of the data signal VDATA.

Figure 7:
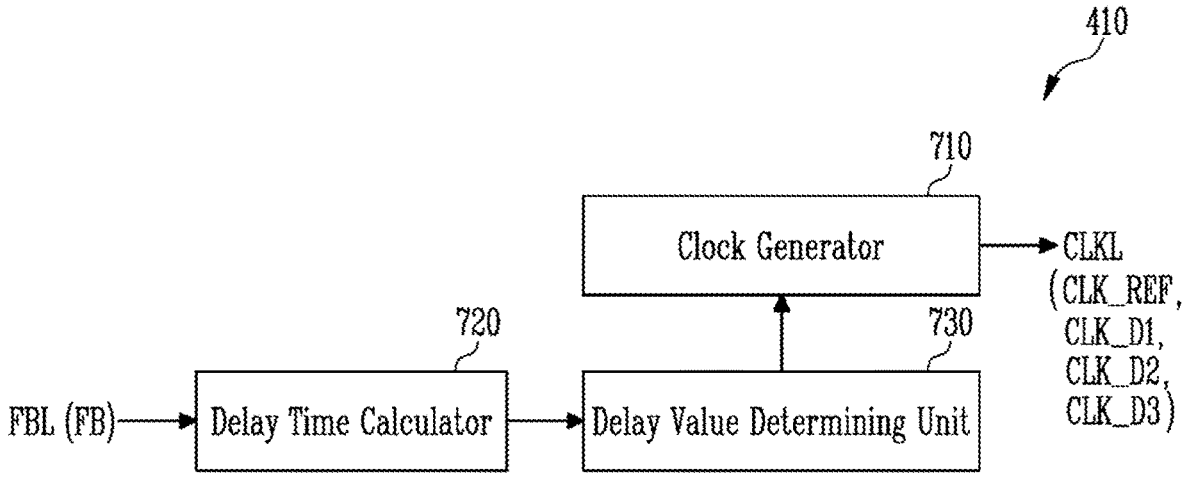
FIG. 7 is a block diagram illustrating an example of a timing controller included in the display device of FIG. 1.
Figure 8:
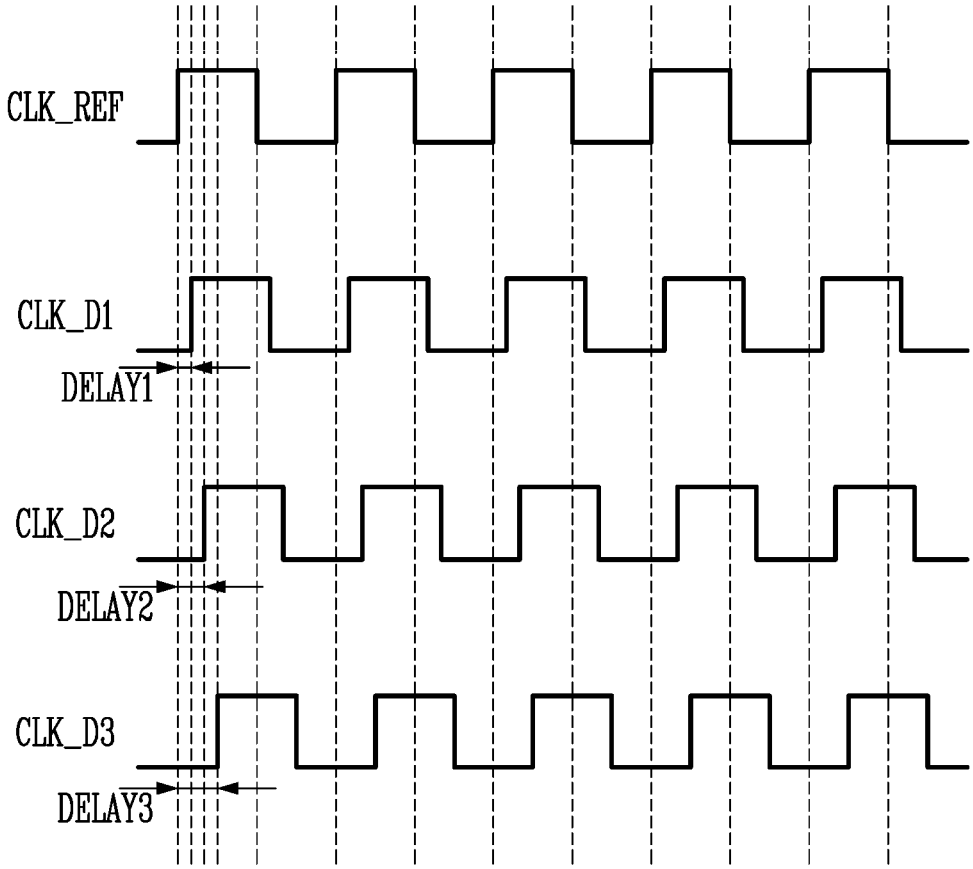
FIG. 8 is a waveform diagram illustrating an example of a reference clock signal and delayed clock signals generated by the timing controller of FIG. 7.
Figure 9A:
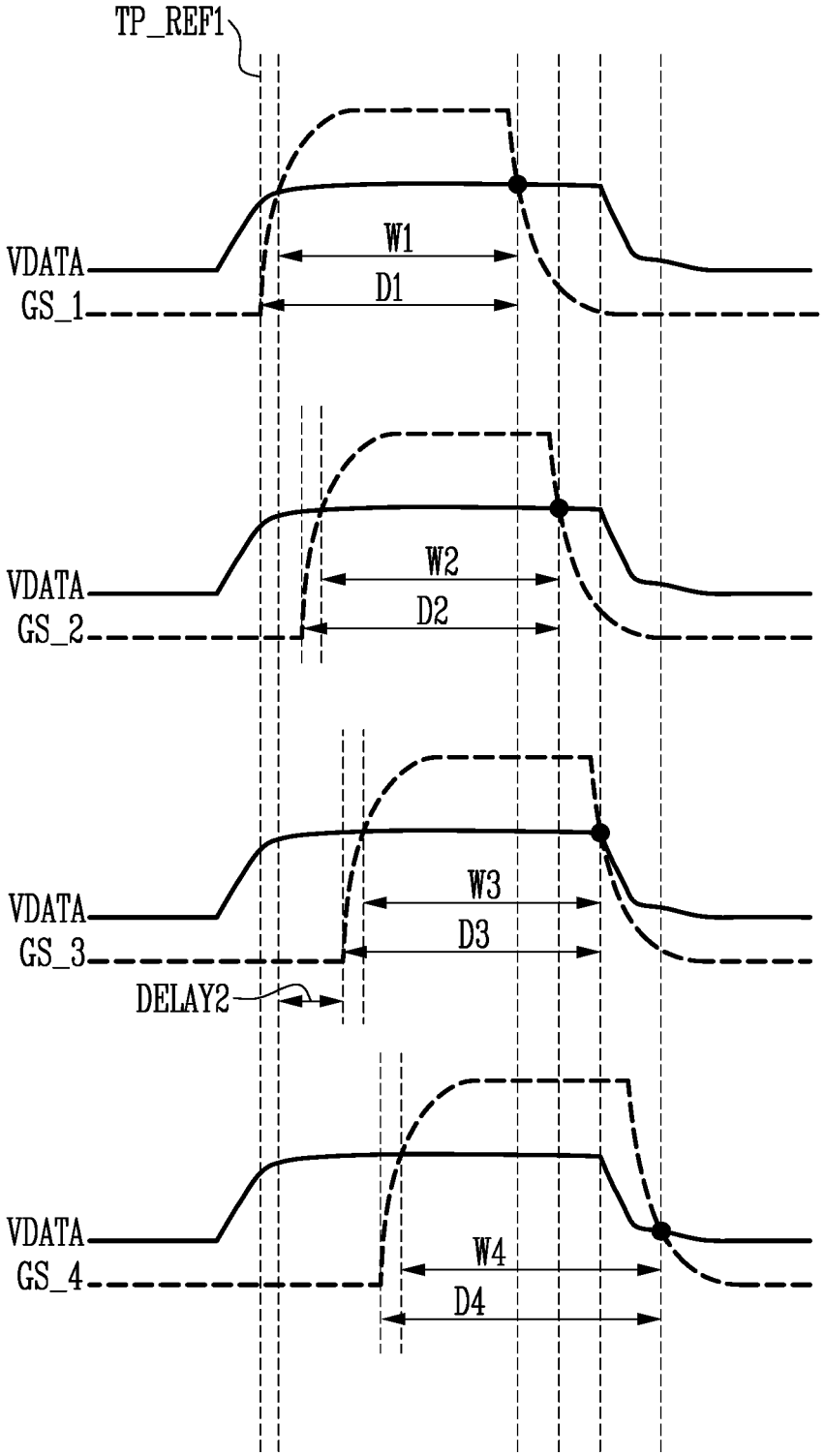
FIGS. 9A and 9B are waveform diagrams for explaining a process of setting a clock signal in the timing controller of FIG. 7.
Figure 9B:
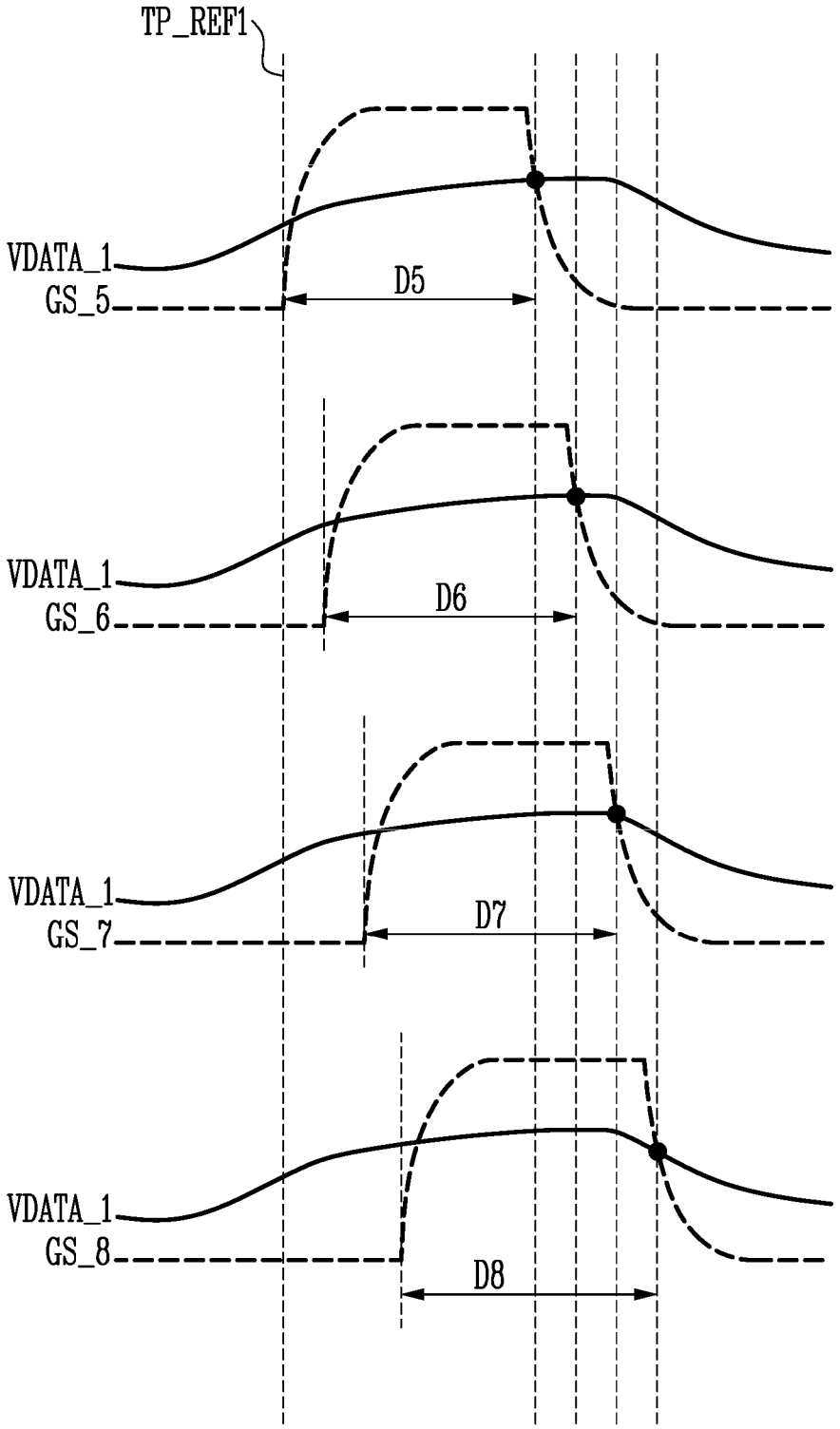
Figure 10A:
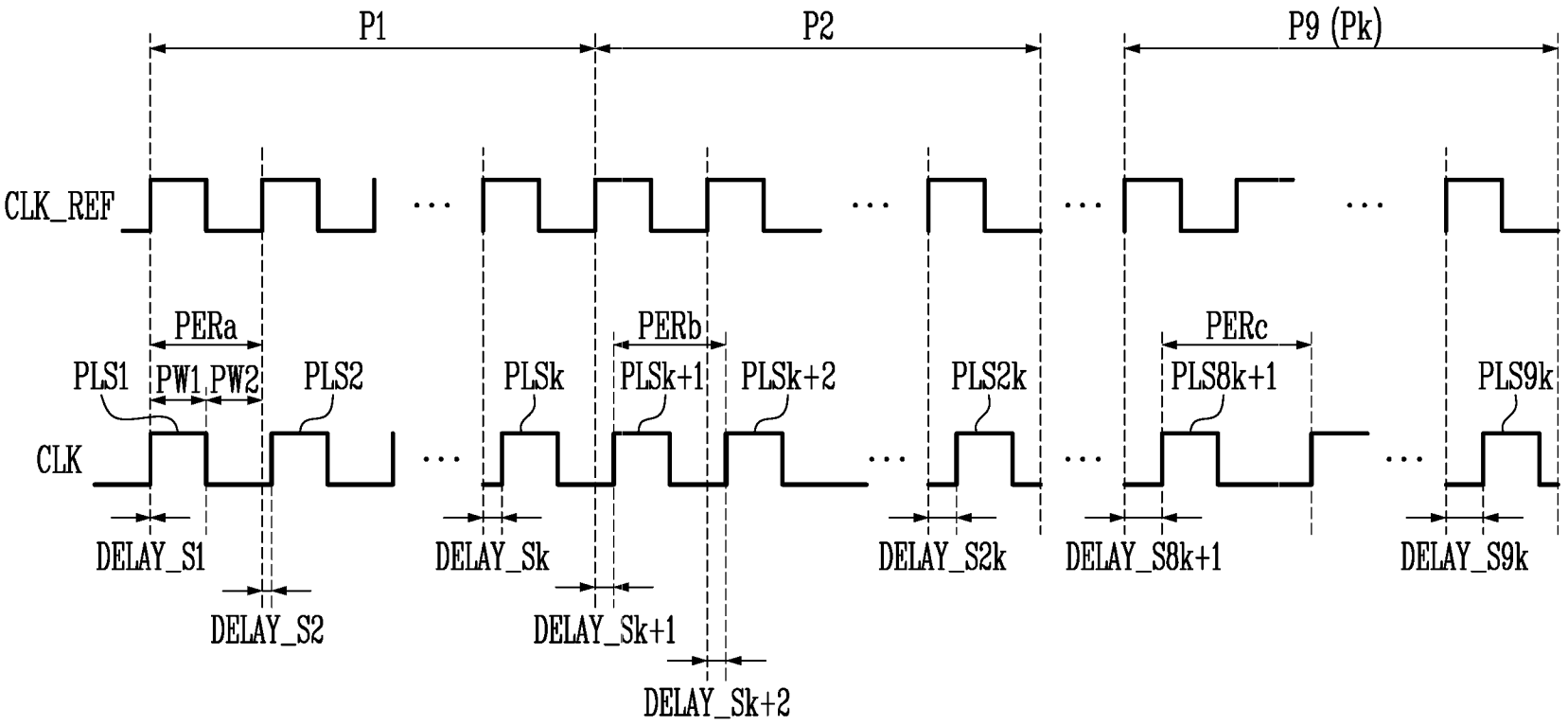
FIGS. 10A and 10B are waveform diagrams illustrating an example of the clock signal set by the timing controller of FIG. 7.
Figure 10B:
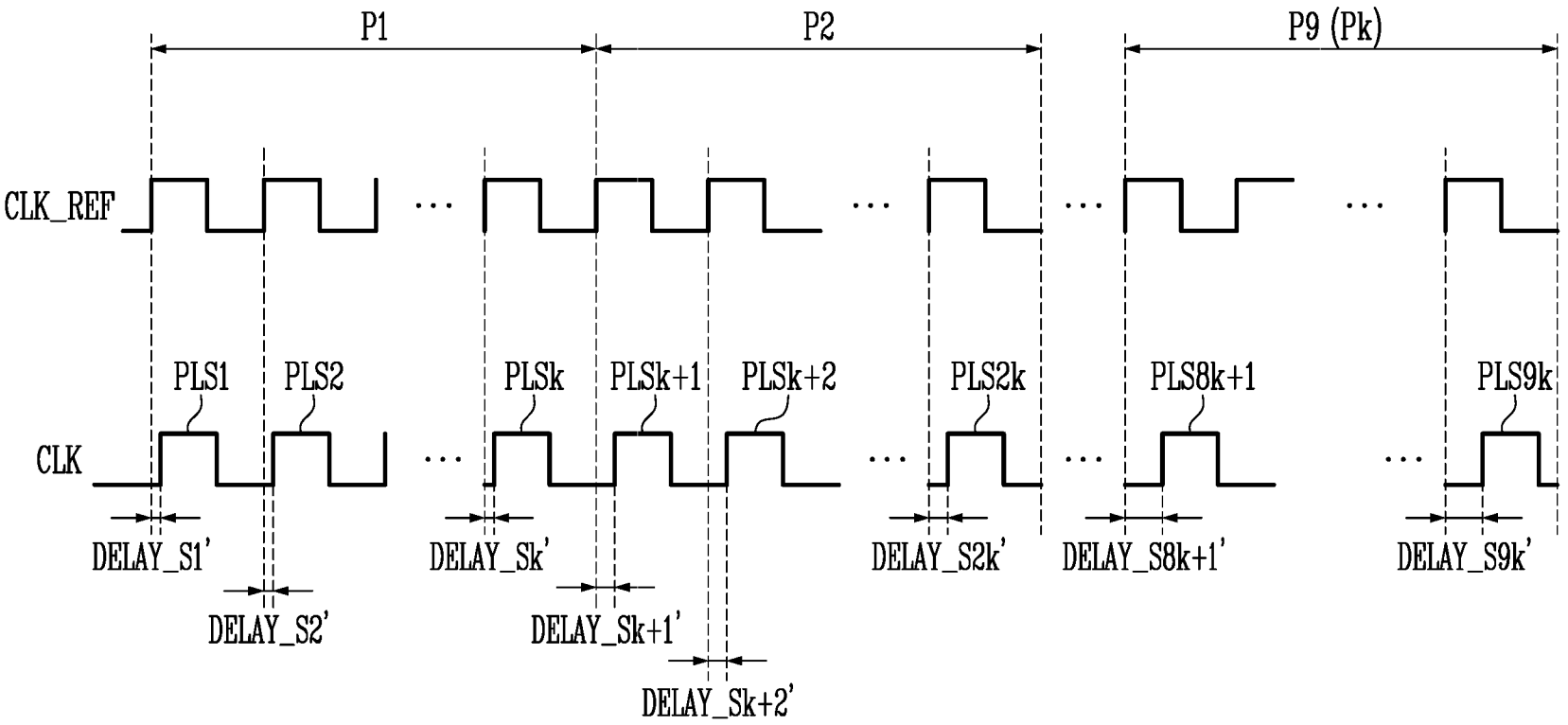

FIG. 7 is a block diagram illustrating an example of a timing controller included in the display device of FIG. 1. FIG. 8 is a waveform diagram illustrating an example of a reference clock signal and delayed clock signals generated by the timing controller of FIG. 7. FIGS. 9A and 9B are waveform diagrams for explaining a process of setting a clock signal in the timing controller of FIG. 7. FIGS. 10A and 10B are waveform diagrams illustrating an example of the clock signal set by the timing controller of FIG. 7.

Referring to FIGS. 1, 6, 7, 8, 9A, 9B, 10A, and 10B, the timing controller 410 may set the clock signal CLK optimized for driving the display device 10 based on a change in the falling edge (that is, the end time point TP_END) of the feedback signal FB while delaying the clock signal CLK. That is, the timing controller 410 may set the delay value (or period) of the clock signal CLK so that the gate signal GS is supplied corresponding to the data signal having the RC delay.

The timing controller 410 may include a clock generator 710, a delay time calculator 720, and a delay value determining unit 730.

The clock generator 710 may generate a reference clock signal CLK_REF and delayed clock signals CLK_D1, CLK_D2, and CLK_D3. Here, the reference clock signal CLK_REF may be the external clock signal provided from an external source or a signal in which the external clock signal is delayed by a predetermined time. As will be described later, in setting the clock signal CLK for the first gate driver IC 210-1 shown in FIG. 3, the reference clock signal CLK_REF may be the external clock signal. In setting the clock signal CLK for the second gate driver IC 210-2 shown in FIG. 2, the reference clock signal CLK_REF may be the clock signal set for the first gate driver IC 210-1. That is, the reference clock signal CLK REF may be set differently for each gate driver IC.

The clock generator 710 may generate the delayed clock signals CLK_D1, CLK_D2, and CLK_D3 by sequentially delaying the reference clock signal CLK_REF by a predetermined time.

As shown in FIG. 8, the reference clock signal CLK_REF and the delayed clock signals CLK_D1, CLK_D2, and CLK_D3 may have substantially equal waveforms, but may have different phases. Since a waveform of the reference clock signal CLK_REF is substantially the same as or similar to the first sub-clock signal CLK_S1 (or the second sub-clock signal CLK_S2) described with reference to FIG. 5, a duplicate description will be omitted.

For example, the clock generator 710 may generate a first delayed clock signal CLK_D1 by delaying the reference clock signal CLK_REF by a first delay value DELAY1 as a whole. Similarly, the clock generator 710 may generate a second delayed clock signal CLK_D2 by delaying the reference clock signal CLK_REF by a second delay value DELAY2 as a whole. Furthermore, the clock generator 710 may generate a third delayed clock signal CLK_D3 by delaying the reference clock signal CLK_REF by a third delay value DELAY3 as a whole. Meanwhile, only the first, second, and third delayed clock signals CLK_D1, CLK_D2, and CLK_D3 are shown in FIG. 7. However, this is an example, and the clock generator 710 may generate four or more delayed clock signals using the same method of generating the first, second, and third delayed clock signals CLK_D1, CLK_D2, and CLK_D3. In addition, differences between the first delay value DELAY1, the second delay value DELAY2, and the third delay value DELAY3 may be equal as or different from each other, and the first delay value DELAY1, the second delay value DELAY2, and the third delay value DELAY3 may be set variously.

The clock generator 710 may sequentially output the reference clock signal CLK_REF and the delayed clock signals CLK_D1, CLK_D2, and CLK_D3 to the clock line CLKL in the process iteratively performed to set or find the optimal clock signal CLK (that is, in each of a plurality of setting sections).

Meanwhile, according to the reference clock signal CLK_REF and the delayed clock signals CLK_D1, CLK_D2, and CLK_D3 output from the clock generator 710, the gate signal GS (refer to FIG. 6) may have the delay values DELAY1, DELAY2, and DELAY3, respectively.

As shown in FIG. 9A, a gate signal GS_1 in a first setting section may be generated based on the reference clock signal CLK_REF, and may not have a delay value or may have a delay value of 0. A waveform of the gate signal GS_1 in the first setting section may be substantially the same as the waveform of the gate signal GS described with reference to FIG. 6. In addition, the waveform of the data signal VDATA may be substantially the same as the waveform of the data signal VDATA (or the first curve C_VDATA1 shown in FIG. 3) described with reference to FIG. 6. Therefore, duplicate descriptions will be omitted.

A gate signal GS_2 in a second setting section may be generated based on the first delayed clock signal CLK_D1, and may have the first delay value DELAY1. That is, based on the gate signal GS_1 in the first setting section, the gate signal GS_2 in the second setting section may have a phase delayed by the first delay value DELAY1.

A gate signal GS_3 in a third setting section may be generated based on the second delayed clock signal CLK_D2, and may have the second delay value DELAY2. A gate signal GS_4 in a fourth setting section may be generated based on the third delayed clock signal CLK_D3, and may have the third delay value DELAY3.

Referring back to FIG. 7, the delay time calculator 720 may receive the feedback signal FB through the feedback line FBL, and calculate the delay time of the data signal VDATA based on the feedback signal FB. For example, the delay time calculator 720 may calculate a timing of the falling edge of the feedback signal FB. For example, the delay time calculator 720 may calculate the timing of the falling edge of the feedback signal FB based on the clock signal CLK. For example, the delay time calculator 720 may calculate the timing (that is, the time difference D) of the falling edge of the feedback signal FB based on the rising edge (for example, the first reference time point TP_REF1) of the clock signal CLK.

Referring to FIG. 9A, according to the gate signal GS_1 in the first setting section, the delay time calculator 720 may calculate a first time difference D1, and determine the first time difference D1 as the timing of the falling edge of the feedback signal FB. For example, in the first setting section, the delay time calculator 720 may calculate the first time difference D1 to the falling edge of the feedback signal FB based on the rising edge of the reference clock signal CLK_REF.

Similarly, according to the gate signal GS_2 in the second setting section, the delay time calculator 720 may calculate a second time difference D2. For example, in the second setting section, the delay time calculator 720 may calculate the second time difference D2 to the falling edge of the feedback signal FB based on the rising edge of the first delayed clock signal CLK_D1.

The delay time calculator 720 may calculate a third time difference D3 according to the gate signal GS_3 in the third setting section. In addition, the delay time calculator 720 may calculate a fourth time difference D4 according to the gate signal GS_4 in the fourth setting section.

However, the present disclosure is not limited thereto. The delay time calculator 720 may determine the timing of the falling edge of the feedback signal FB in various ways. For example, as described with reference to FIG. 6, the delay time calculator 720 may calculate pulse widths W1, W2, W3, and W4 of the feedback signal FB in the first, second, third, and fourth setting sections, respectively, and determine the pulse widths W1, W2, W3, and W4 as the timing of the falling edge in each of the first, second, third, and fourth setting sections. As another embodiment, the delay time calculator 720 may determine the interval G described with reference to FIG. 6 (that is, a difference between the second reference time point TP_REF and the end time point TP_END) as the timing of the falling edge.

Referring back to FIG. 7, the delay value determining unit 730 may control the clock generator 710 to output one of the reference clock signal CLK_REF and the delayed clock signals CLK_D1, CLK_D2, and CLK_D3 as the clock signal based on a change in the timing of the falling edge of the feedback signal FB. For example, when the change in the timing of the falling edge of the feedback signal FB in a corresponding setting section does not satisfy a predetermined condition, the delay value determining unit 730 may control the clock generator 710 to output the clock signal having a larger delay value in the next setting section.

In embodiments, when the change in the timing (that is, the first, second, third, and fourth time differences D1 to D4) of the falling edge of the feedback signal FB according to the reference clock signal CLK_REF and the delayed clock signals CLK_D1, CLK_D2, and CLK_D3 is maintained within a reference range and is out of the reference range, the delay value determining unit 730 may finally set the clock signal CLK or finally determine the delay value of the clock signal CLK based on the clock signal (for example, the second delayed clock signal CLK_D2) corresponding to the timing (for example, the third time difference D3) maintained within the reference range.

Referring to FIG. 9A, for example, the second time difference D2 in the second setting section (that is, the timing of the falling edge of the feedback signal FB) may be similar to the first time difference D1 in the first setting section. That is, a difference between the second time difference D2 and the first time difference D1 may substantially be equal to 0.

Similarly, the third time difference D3 in the third setting section may be similar to the second time difference D2 in the second setting section. That is, a difference between the third time difference D3 and the second time difference D2 may substantially be equal to 0.

Meanwhile, the fourth time difference D4 in the fourth setting section may be greater than the third time difference D3 in the third setting section. In the fourth setting section, the timing of the falling edge of the feedback signal FB may be relatively delayed while a waveform of the gate signal GS_4 intersects a falling portion of the data signal VDATA (rather than a peak portion of the data signal VDATA).

Accordingly, the delay value determining unit 730 may finally set the clock signal CLK based on the second delayed clock signal CLK_D2 corresponding to the third setting section (or the second delay value DELAY2 of the second delayed clock signal CLK_D2).

In embodiments, the delay value determining unit 730 may set sub-delay values of each of the pulses of the clock signal CLK based on a location at which the data signal VDATA is sensed and the delay value of the selected delayed clock signal.

For example, hereafter, it is assumed that the data signal VDATA of FIG. 9A is provided through the first connection line CL1 (refer to FIG. 4) and the second delay value DELAY2 of the second delayed clock signal CLK_D2 is selected.

In this case, the n-th gate signal GSn having the second delay value DELAY2 should be applied to the n-th gate line GLn (refer to FIG. 4), and the first to n-th gate signals GS1 to GSn may have the delay values that sequentially increase to a maximum second delay value DELAY2, respectively. Accordingly, each of the pulses of the clock signal CLK corresponding to the first to n-th gate signals GS1 to GSn may have corresponding delay values, respectively. To this end, the delay value determining unit 730 may interpolate the second delay value DELAY2 based on the n-th gate line GLn (or n gate lines) to set a sub-delay value of each of the pulses of the clock signal CLK.

Referring to FIG. 10A, a first section P1 may be a section in which the clock signal CLK is provided to the first gate driver IC 210-1 (refer to FIG. 2).

In the first section P1, based on the reference clock signal CLK_REF (or the external clock signal), a first pulse PLS1 of the clock signal CLK may have a first sub-delay value DELAYS 1, a second pulse PLS2 may have a second sub-delay value DELAY_S2, and a k-th pulse PLSk may have a k-th sub-delay value DELAY_Sk. Here, k may be a positive integer less than n. For example, as described with reference to FIG. 4, when the stages ST1, ST2, . . . , and STn alternately output the two sub-clock signals CLK_S1 and CLK_S2 as the gate signal, k may be n/2.

For example, the first sub-delay value DELAY_S1 may be 0, the k-th sub-delay value DELAY_Sk may be the same as the second delay value DELAY2, and the second sub-delay value DELAY_S2 may be equal to a value obtained by dividing the second delay value DELAY2 by k. For example, DELAY_S1=DELAY2/k*(i−1), where i is an integer less than k.

The sub-delay values from DELAY_S1 to DELAY_Sk of the pulses from PLS1 to PLSk of the clock signal CLK may be stored in a separate memory device. The timing controller 410 (or the clock generator 710) may generate the clock signal CLK by sequentially delaying pulses of the external clock signal provided from the outside based on the sub-delay values from DELAY_S1 to DELAY_Sk.

In other words, the delay value determining unit 730 may adjust or increase a first period PERa of the clock signal CLK (that is, the clock signal CLK for the first gate driver IC 210-1) in the first section P1 by the first sub-delay value DELAY_S1.

Meanwhile, in FIG. 10A, the sub-delay values from DELAY_S1 to DELAY_Sk of the pulses from PLS1 to PLSk of the clock signal CLK have been described as being different from each other. However, the sub-delay values from DELAY_S1 to DELAY_Sk of the pulses from PLS1 to PLSk of the clock signal CLK are not limited thereto.

For example, when the n-th gate signal GSn having the second delay value DELAY2 is applied to the n-th gate line GLn (refer to FIG. 4), the first to n-th gate signals GS1 to GSn may have delay values equal to the second delay value DELAY2. Accordingly, each of the pulses of the clock signal CLK corresponding to the first to n-th gate signals GS1 to GSn may have corresponding delay values.

Referring to FIG. 10B, waveforms corresponding to FIG. 10A are shown.

In the first section P1, based on the reference clock signal CLK_REF (or the external clock signal), the first pulse PLS1 of the clock signal CLK may have a first sub-delay value DELAY_S1', the second pulse PLS2 may have a second sub-delay value DELAY_S2', and the k-th pulse PLSk may have a k-th sub-delay value DELAY_Sk'.

For example, each of the first sub-delay value DELAY_S1', a second sub-delay value DELAY_S2', and the k-th sub-delay value DELAY_Sk' may be the same as the second delay value DELAY2.

That is, the clock signal CLK may have the same waveform (or the same period) as the reference clock signal CLK_REF, and may be delayed by a specific delay value (for example, the second delay value DELAY2) based on the reference clock signal CLK_REF.

The delay value of the clock signal CLK for the first section P1 may be stored in a separate memory device. The timing controller 410 (or the clock generator 710) may generate the clock signal CLK by delaying the external clock signal provided from the outside based on the delay value.

Hereinafter, another example will be described with reference to FIG. 9B. FIG. 9B shows waveforms corresponding to FIG. 9A. A waveform of a data signal VDATA_1 is different from the waveform of the data signal VDATA of FIG. 9A and may be the same as or similar to the second curve C_VDATA2 described with reference to FIG. 3.

For reference, the waveforms shown in FIG. 9A may be referenced to describe the process of setting the clock signal CLK of the first gate driver IC 210-1 based on the data signal in the first connection line CL1 shown in FIG. 2. On the other hand, the waveforms shown in FIG. 9B may be referenced to describe the process of setting the clock signal CLK of the second gate driver IC 210-2 based on the data signal in the second connection line CL2 shown in FIG. 2.

Referring back to FIGS. 8 and 9B, a gate signal GS_5 in a fifth setting section may be generated based on the reference clock signal CLK_REF. Here, the reference clock signal CLK_REF may be the clock signal CLK finally set for the first gate driver IC 210-1 (for example, the clock signal CLK in which the second delay value DELAY2 is reflected). A gate signal GS_6 in a sixth setting section may have the first delay value DELAY1 based on the fifth gate signal GS_5. A gate signal GS_7 in a seventh setting section may have the second delay value DELAY2 based on the fifth gate signal GS_5. A gate signal GS_8 in an eighth setting section may have the third delay value DELAY3 based on the fifth gate signal GS_5.

A sixth time difference D6 in the sixth setting section (that is, the timing of the falling edge of the feedback signal FB) may be similar to a fifth time difference D5 in the fifth setting section. That is, a difference between the sixth time difference D6 and the fifth time difference D5 may substantially be equal to 0.

Similarly, a seventh time difference D7 in the seventh setting section may be similar to the sixth time difference D6 in the sixth setting section.

An eighth time difference D8 in the eighth setting section may be greater than the seventh time difference D7 in the seventh setting section.

In this case, the delay value determining unit 730 may finally set the clock signal CLK for the second gate driver IC 210-2 based on the delayed clock signal corresponding to the seventh setting section.

Alternatively, when the eighth time difference D8 is greater than the seventh time difference D7, but it is determined that a difference between the eighth time difference D8 and the seventh time difference D7 is within the reference range (for example, less than the reference range), the delay value determining unit 730 may finally set the clock signal CLK for the second gate driver IC 210-2 based on the delayed clock signal corresponding to the eighth setting section.

As described above, the delay value determining unit 730 may set the sub-delay values of each of the pulses of the clock signal CLK for the second gate driver IC 210-2 based on the location at which the data signal VDATA is sensed and the delay value of the selected delayed clock signal.

For example, the delay value determining unit 730 may interpolate the delay value of the gate signal GS7 based on the 2n-th gate line GL2*n* to set the sub-delay value of each of the pulses of the clock signal CLK for the second gate driver IC 210-2. For example, the delay value determining unit 730 may interpolate the maximum delay value of the first gate driver IC 210-1 (refer to FIG. 2) and the delay value of the gate signal GS7 based on the 2n-th gate line GL2*n* (that is, the (n+1)th to 2n-th gate lines GLn+1 to GL2*n* shown in FIG. 2) to set the sub-delay value of each of the pulses of the clock signal CLK for the second gate driver IC 210-2.

Referring back to FIG. 10A, the second section P2 may be a section in which the clock signal CLK is provided to the second gate driver IC 210-2 (refer to FIG. 2).

In the second section P2, a (k+1)th pulse PLSk+1 of the clock signal CLK may have a (k+1)th sub-delay value DELAY_Sk+1, a (k+2)th pulse PLSk+2 may have a (k+2)th sub-delay value DELAY_Sk+2, and a 2k-th pulse PLS2*k* may have a 2k-th sub-delay value DELAY_S2*k*. The (k+1)th sub-delay value DELAY_Sk+1, the (k+2)th sub-delay value DELAY_Sk+2, and the 2k-th sub-delay value DELAY_S2*k* may have different values, but the present disclosure is not limited thereto. For example, as shown in FIG. 10B, a (k+1)th sub-delay value DELAY_Sk+1', a (k+2)th sub-delay value DELAY_Sk+2', and a 2k-th sub-delay value DELAY_S2*k*' may have the same value.

In an embodiment, a difference between the (k+1)th sub-delay value DELAY_Sk+1 and the k-th sub-delay value DELAY_Sk may be different from a difference between the second sub-delay value DELAY_S2 and the first sub-delay value DELAY_S1.

That is, a second period PERb of the clock signal CLK in the second section P2 for the second gate driver IC 210-2 may be different from the first period PERa of the clock signal CLK in the first section P1.

A ninth section P9 may be a section in which the clock signal CLK is provided to a ninth gate driver IC (that is, a gate driver IC most distant from the data driver 300 shown in FIG. 2).

In the ninth section P9, an (8k+1)th pulse PLS8*k*+1 of the clock signal CLK may have an (8k+1)th sub-delay value DELAY_S8k+1, and a 9k-th pulse PLS9*k* may have a 9k-th sub-delay value DELAY_S9*k*. As shown in FIG. 10A, the (8k+1)th sub-delay value DELAY_Sk+1 and the 9k-th sub-delay value DELAY_S9*k* may have different values. As shown in FIG. 10B, an (8k+1)th sub-delay value DELAY_S8k+1' and a 9k-th sub-delay value DELAY_S9*k*' may have different values.

A third period PERc of the clock signal CLK in the ninth section P9 for the ninth gate driver IC may be the same as or different from the first period PERa of the clock signal CLK in the first section P1 and the second period PERb of the clock signal CLK in the second section P1, respectively.

As described with reference to FIGS. 7, 8, 9A, 9B, 10A, and 10B, the timing controller 410 may monitor the change in the timing of the falling edge of the feedback signal FB while increasing the delay value of the clock signal CLK. In addition, the timing controller 410 may select or determine the delay value of the clock signal CLK that keeps the change in the timing of the falling edge of the feedback signal FB constant (for example, to the smallest), and set the sub-delay values of each of the pulses of the clock signal CLK or determine the period of the clock signal CLK based on the delay value of the clock signal CLK.

In addition, when the display device 10 includes the plurality of gate driver ICs 210-1 and 210-2, clock signals CLK for the gate driver ICs 210-1 and 210-2 may be set, respectively.

Accordingly, in a section in which the data signal having the RC delay has the peak value, the gate driver ICs 210-1 and 210-2 may output the gate signal based on the clock signal CLK. Therefore, the charging rate of the data signal of the pixel can be improved, and the quality of the image displayed on the display device 10 can be improved.

Figure 11:
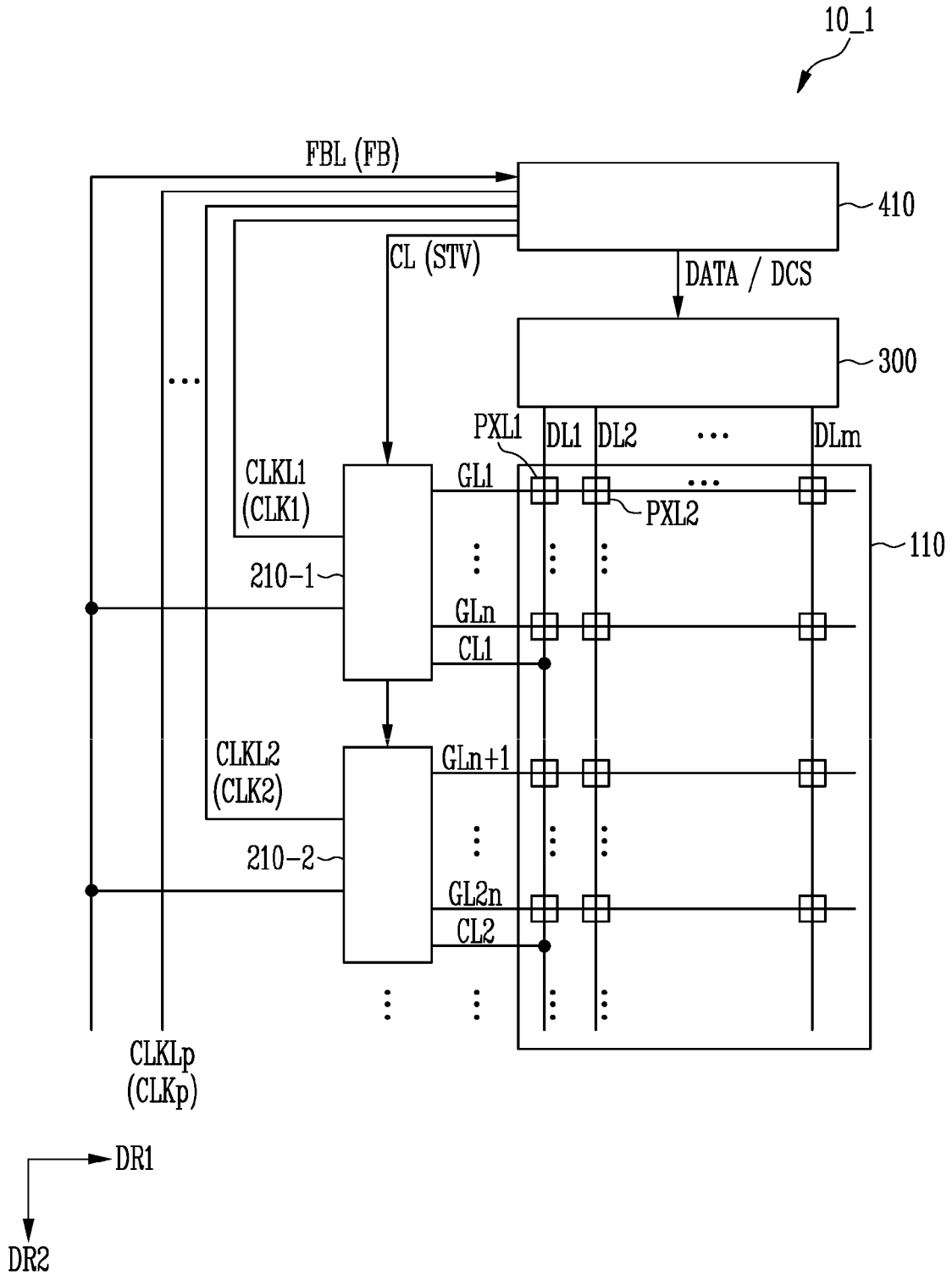
FIG. 11 is a diagram illustrating another example of the display device of FIG. 1.
Figure 12:
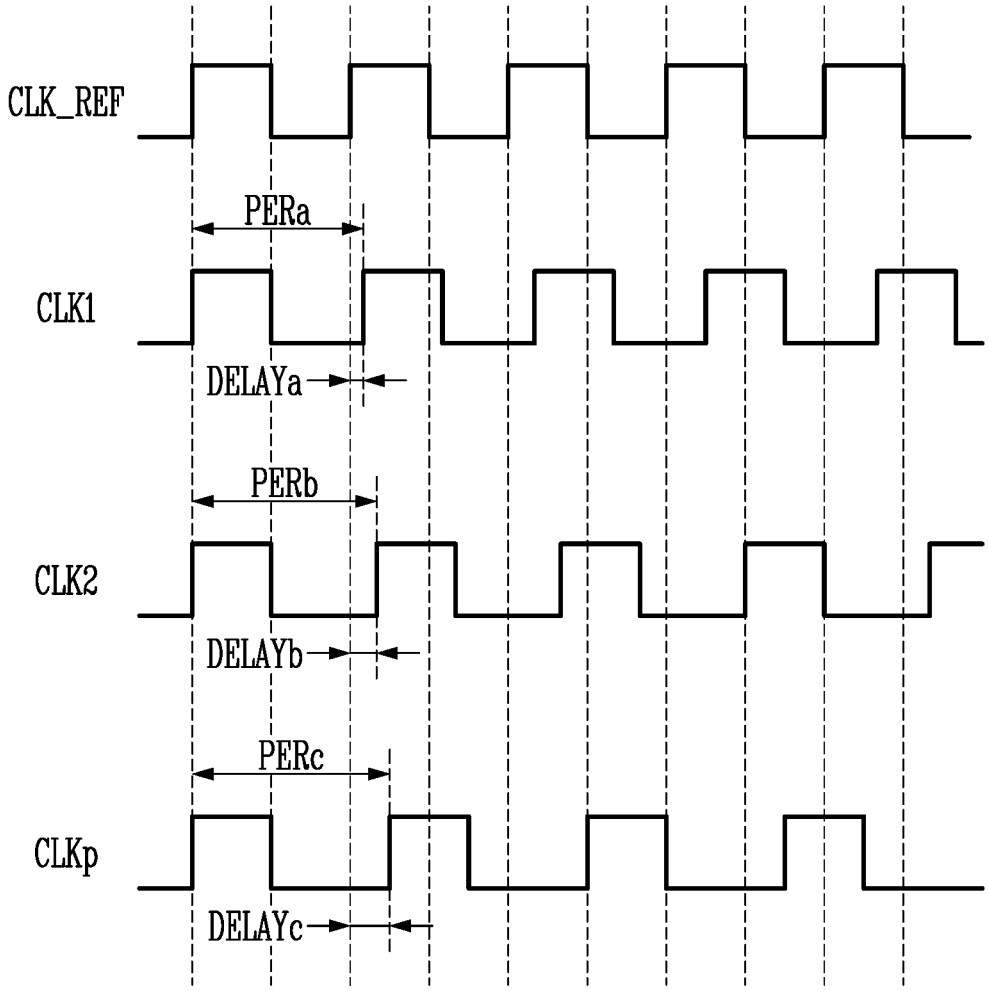
FIG. 12 is a waveform diagram illustrating an example of clock signals set by the timing controller included in the display device of FIG. 11.

FIG. 11 is a diagram illustrating another example of the display device of FIG. 1. FIG. 12 is a waveform diagram illustrating an example of clock signals set by the timing controller included in the display device of FIG. 11.

Referring to FIGS. 1, 2 and 11, a display device 10_1 of FIG. 11 is different from the display device 10 of FIG. 2 in that the display device 10_1 includes a plurality of clock lines CLKL1, CLKL2, . . . , and CLKLp. Except for the clock lines CLKL1, CLKL2, . . . , and CLKLp, the display device 10_1 may be substantially the same as or similar to the display device 10 of FIG. 2, and thus duplicate descriptions will be omitted.

A first clock line CLKL1 may be connected to the timing controller 410 and the first gate driver IC 210-1. The timing controller 410 may provide a first clock signal CLK1 to the first gate driver IC 210-1 through the first clock line CLKL1. The first gate driver IC 210-1 may generate the gate signals based on the first clock signal CLK1.

As shown in FIG. 12, the first clock signal CLK1 may have the first period PERa, and the first period PERa may be greater than a period of the reference clock signal CLK_REF by a first delay time DELAYa. Here, the first delay time DELAYa may be equal to the second sub-delay value DELAY_S2 described with reference to FIG. 10A (or the second sub-delay value DELAY_S2' described with reference to FIG. 10B).

A second clock line CLKL2 may be connected to the timing controller 410 and the second gate driver IC 210-2. The timing controller 410 may provide a second clock signal CLK2 to the second gate driver IC 210-2 through the second clock line CLKL2. The second gate driver IC 210-2 may generate the gate signals based on the second clock signal CLK2.

As shown in FIG. 12, the second clock signal CLK2 may have the second period PERb, and the second period PERb may be greater than the period of the reference clock signal CLK_REF by a second delay time DELAYb. Here, the second delay time DELAYb may be equal to a difference between the (k+2)th sub-delay value DELAY_Sk+2 and the (k+1)th sub-delay value DELAY_Sk+1 described with reference to FIG. 10A.

A p-th clock line CLKLp may be connected to the timing controller 410 and a p-th gate driver IC. The timing controller 410 may provide a p-th clock signal CLKp to the second gate driver IC through the p-th clock line CLKLp. The p-th gate driver IC may generate the gate signals based on the p-th clock signal CLKp. Here, p is a positive integer. Referring to FIG. 1, for example, p may be 9.

As shown in FIG. 12, the p-th clock signal CLKp may have the third period PERc, and the third period PERc may be greater than the period of the reference clock signal CLK_REF by a third delay time DELAYc. Here, the third delay time DELAYc may be the same as or different from the first delay time DELAYa and/or the second delay time DELAYb. However, since the RC delay of the data signal increases as the distance from the data driver 300 increases, the third delay time DELAYc may be greater than the first delay time DELAYa and the second delay time DELAYb.

When the timing controller 410 provides the clock signals CLK1, CLK2, . . . , and CLKp to the gate driver ICs 210-1, and 210-2, . . . , and the p-th gate driver IC through the plurality of clock lines CLKL1, CLKL2, . . . , and CLKLp, the timing controller 410 may set the clock signals CLK1, CLK2, . . . , and CLKp independently of each other.

For example, the display device 10 of FIG. 2 may set the clock signal CLK (that is, the clock signal CLK in the first section P1 of FIG. 10A) for the first gate driver IC 210-1, and then set the clock signal CLK (that is, the clock signal CLK in the second section P2 of FIG. 10A) for the second gate driver IC 210-2 on the premise of the clock signal CLK for the first gate driver IC 210-1. That is, since the clock signal CLK has different periods or delay values partially in time division, the clock signal CLK must be sequentially set.

Meanwhile, since the clock signals CLK1, CLK2, . . . , and CLKp are physically separated from each other in the display device 10_1 of FIG. 11, the clock signals CLK1, CLK2, . . . , and CLKp may be set independently (that is, individually) of each other.

Figure 13:
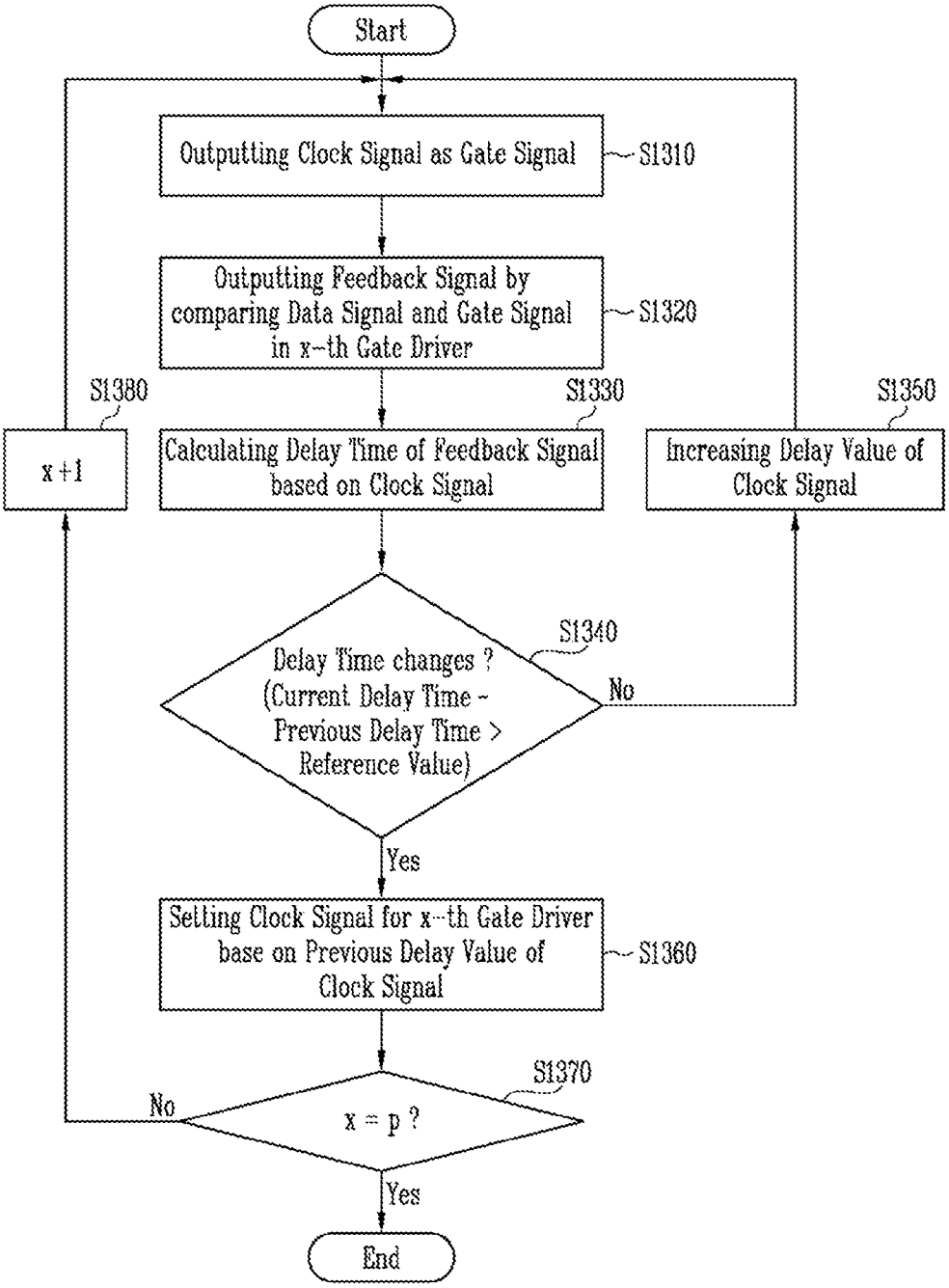
FIG. 13 is a flowchart illustrating a method of driving a display device according to an embodiment of the present disclosure.

FIG. 13 is a flowchart illustrating a method of driving a display device according to an embodiment of the present disclosure.

Referring to FIGS. 1, 2 and 13, a method of driving a display device may be performed in the display device 10 of FIGS. 1 and 2 (or the display device 10_1 of FIG. 11). The method of FIG. 13 may be performed in a separate setting section (or clock setting section).

The method of FIG. 13 may provide the data signals to the data lines through the data driver 300, and sequentially output the clock signal CLK to the gate lines GL1 to GLn and GLn+1 to GL2*n* through the gate driver 200 (or one of the gate driver ICs 210-1 and 210-2) (S1310).

As described with reference to FIG. 2, the data driver 300 may provide the data signal (or the test signal) to the first data line DLL In addition, as described with reference to FIG. 4, the first gate driver IC 210-1 may output the clock signal CLK to the n-th gate line GLn as the n-th gate signal GSn.

The method of FIG. 13 may output the feedback signal by comparing the data signal and the gate signal through an x-th gate driver IC (S1320). Here, x may be a positive integer and may have a value of 1 for the first time.

As described with reference to FIGS. 2 and 4, the first gate driver IC 210-1 may generate the feedback signal FB by comparing the data signal provided through the first connection line CL1 and the n-th gate signal GSn, and output the feedback signal FB to the feedback line FBL.

As described with reference to FIG. 6, when the gate signal GS is greater than or equal to the data signal VDATA, the feedback signal FB may have the logic high level. In addition, when the gate signal GS is smaller than the data signal VDATA, the feedback signal FB may have the logic low level.

The method of FIG. 13 may calculate the delay time of the feedback signal FB based on the clock signal CLK (S1330).

As described with reference to FIGS. 6 and 7, the timing controller 410 (or the delay time calculator 720) may calculate the timing of the falling edge (or a second edge of the pulse) of the feedback signal FB based on the clock signal CLK. For example, the timing controller 410 may calculate the timing (that is, the time difference D) of the falling edge of the feedback signal FB based on the rising edge (that is, the first reference time point TP_REF1 shown in FIG. 6) of the clock signal CLK.

The method of FIG. 13 may set the delay value of the clock signal based on a change in the delay time (or the timing of the falling edge) of the feedback signal FB.

In an embodiment, the method of FIG. 13 may determine whether the delay time of the feedback signal FB is out of the reference range, that is, whether the delay time of the feedback signal FB is changed (S1340).

For example, the method of FIG. 13 may determine whether a difference between a current delay time (that is, the delay time of the feedback signal FB calculated in a current setting section, for example, in the second setting section section described with reference to FIG. 9A) and a previous delay time (that is, the delay time of the feedback signal FB calculated in a previous setting section, for example, the first setting section described with reference to FIG. 9A) is greater than a reference value. For example, the method of FIG. 13 may determine whether the current delay time is greater than the previous delay time.

As described with reference to FIG. 9A, when a peak section of the data signal VDATA overlaps with the gate signal GS, the delay time of the feedback signal FB may be maintained at the minimum value. Alternatively, when the peak section of the data signal VDATA partially overlaps with the gate signal GS, the delay time of the feedback signal FB may relatively increase. Accordingly, the method of FIG. 13 may find a time point in which the amount of change in the delay time decreases and remains constant (for example, a time point in which the peak section of the data signal VDATA and the gate signal GS start to overlap), and a time point in which the amount of change in the delay time remains constant and increases (for example, a time point in which the gate signal GS starts to deviate from the peak section of the data signal VDATA).

When the delay time of the feedback signal FB is not changed, the method of FIG. 13 may increase the delay value of the clock signal (S1350). In addition, the method of FIG. 13 may perform a step of outputting the clock signal CLK as the gate signal (S1310), a step of outputting the feedback signal (S1320), a step of calculating the delay time of the feedback signal (S1330), and a step of determining whether the delay time is changed (S1340) again.

As described with reference to FIGS. 7, 8, and 9A, the timing controller 410 may sequentially generate the delayed clock signals CLK_D1, CLK_D2, and CLK_D3, and determine whether the delay time of the feedback signal FB is changed according to the delayed clock signals CLK_D1, CLK_D2, and CLK_D3 in a plurality of setting sections.

When the delay time of the feedback signal FB is changed (or when the delay time increases), the clock signal for the x-th gate driver IC may be set based on a previous delay value of the clock signal CLK (S1360).

As described with reference to FIG. 9A, when the delay time is changed in the fourth setting section, the method of FIG. 13 may set the clock signal CLK for the first gate driver IC 210-1 based on the second delay value DELAY2 of the second delayed clock signal CLK_D2 in the third setting section. For example, as described with reference to FIG. 10A, the second delay value DELAY2 may be interpolated based on the n-th gate line GLn to set the sub-delay values of each of the pulses PLS1 to PLSk of the clock signal CLK in the first section P1. As another embodiment, as described with reference to FIG. 12, a period of the first clock signal CLK1 may be set based on the second delay value DELAY2. As another embodiment, as described with reference to FIG. 10B, the delay value of the clock signal CLK in the first section P1 may be set based on the second delay value DELAY2 based on the n-th gate line GLn.

Thereafter, the method of FIG. 13 may set the clock signal CLK for the gate driver IC located after the x-th gate driver IC (that is, further spaced than the x-th gate driver IC from the data driver 300).

The method of FIG. 13 may determine whether the clock signals CLK are completely set for all gate driver ICs in the gate driver 200. For example, when the gate driver 200 includes p gate driver ICs, the method of FIG. 13 may determine whether the constant x is equal to the constant p (S1370).

When the constant x is not equal to the constant p, the method of FIG. 13 may increase the constant x by 1 (S1380), and set the clock signal CLK for the corresponding gate driver IC.

For example, when the clock signal CLK for the first gate driver IC 210-1 is completely set, the method of FIG. 13 may set the clock signal CLK for the second gate driver IC 210-2.

Referring to FIG. 1, for example, when the gate driver 200 includes nine gate driver ICs, the method of FIG. 13 may sequentially set the clock signal CLK for each of the nine gate driver ICs.

As described with reference to FIG. 13, the method of driving the display device may generate the feedback signal FB containing the delay information of the data signal by comparing the data signal of the first data line DL1 and a specific gate signal through the gate driver 200. In addition, the method of driving the display device may monitor the change in the timing of the second edge of the feedback signal FB while increasing the delay value of the clock signal CLK, finally determine the delay value of the clock signal CLK that keeps the change constant (for example, to the smallest), and set the sub-delay values of each of the pulses of the clock signal CLK or determine the period of the clock signal CLK based on the determined delay value. The clock signal CLK may be the gate signal and may be supplied to the pixel at the same time as the data signal having the RC delay. That is, the timings at which the data signal and the gate signal are supplied may coincide with each other. Accordingly, the charging rate of the data signal of the pixel can be improved, and the quality of the image displayed on the display device can be improved.

The display device and the method of driving the same according to the embodiments of the present disclosure may generate the feedback signal containing the delay information of the data signal by comparing the data signal of the data line and the specific gate signal through the gate driver, monitor the change in the second edge (for example, the falling edge of the pulse) of the feedback signal while increasing the delay value of the clock signal, and determine the delay value of the clock signal that keeps the change constant (for example, to the smallest). The gate signal generated based on the clock signal reflecting the delay value may be supplied to the pixel at the same time point (or time) as the data signal having the RC delay. That is, the timings at which the data signal and the gate signal are supplied may coincide with each other. Accordingly, the charging rate of the data signal of the pixel can be improved, and the quality of the image displayed on the display device can be improved.

The detailed description of the present disclosure described with reference to the accompanying drawings is merely illustrative of the disclosure, and is used only for the purpose of illustrating the disclosure and is not intended to limit the meaning of the disclosure or to limit the scope of the disclosure described in the claims. Therefore, those skilled in the art will understand that various modifications and equivalent other embodiments are possible therefrom. Accordingly, the true technical protection scope of the present disclosure should be defined by the technical spirit of the appended claims.

What is claimed is:

1. A display device comprising:

a display panel including a plurality of gate lines, a plurality of data lines, and a plurality of pixels connected to the plurality of data lines and the plurality of gate lines;

a data driver providing data signals to the plurality of data lines;

a gate driver sequentially generating gate signals corresponding to a start pulse using a clock signal and providing the gate signals to the plurality of gate lines; and a timing controller providing the clock signal and the start pulse to the gate driver, wherein the gate driver generates a feedback signal by comparing a data signal provided to a first data line among the plurality of data lines and at least one of the gate signals, and wherein the timing controller sets a delay value of the clock signal based on the feedback signal.

2. The display device of claim 1, wherein the first data line among the plurality of data lines is located closest to the gate driver.

3. The display device of claim 1, further comprising:

a first connection line adjacent to an n-th gate line (where n is a positive integer) among the plurality of gate lines and connected to the first data line, wherein the gate driver receives the data signal through the first connection line and compares an n-th gate signal applied to the n-th gate line and the data signal.

4. The display device of claim 3, wherein a data signal measured at the first connection line includes a resistance-capacitance delay with respect to a data signal measured at an output terminal of the data driver.

5. The display device of claim 3, wherein the gate driver includes a plurality of gate driving circuits, wherein a first gate driving circuit among the gate driving circuits includes:

a plurality of stages respectively connected to each of corresponding first group gate lines among the plurality of gate lines; and a comparator connected to each of the n-th gate line and the first connection line respectively, and wherein each of the stages outputs the clock signal as a gate signal in response to the start pulse or a carry signal of a previous stage.

6. The display device of claim 5, wherein the n-th gate line among the first group gate lines is located farthest away from the data driver.

7. The display device of claim 5, wherein the n-th gate signal is changed within a first voltage range, wherein the data signal is changed within a second voltage range, and wherein the second voltage range is a subset of the first voltage range.

8. The display device of claim 5, wherein the comparator outputs the feedback signal having a first logic level when a voltage level of the n-th gate signal is greater than or equal to a voltage level of the data signal, and outputs the feedback signal having a second logic level when the voltage level of the n-th gate signal is lower than the voltage level of the data signal.

9. The display device of claim 5, wherein the feedback signal includes a pulse, and the pulse includes first and second edges that occur sequentially, and wherein the timing controller determines the delay value of the clock signal based on a change in timing of the second edge of the pulse with respect to the clock signal.

10. The display device of claim 9, wherein the timing controller includes:

a clock generator generating a reference clock signal and delayed clock signals in which the reference clock signal is delayed;

a delay time calculator calculating the timing of the second edge of the feedback signal; and a delay value determining unit controlling the clock generator to output one of the reference clock signal and the delayed clock signals as the clock signal based on the change in the timing.

11. The display device of claim 10, wherein when changes in timings of the second edge according to the delayed clock signals are maintained within a reference range and then out of the reference range, the delay value determining unit determines the delay value of the clock signal based on a first timing maintained within the reference range among the timings.

12. The display device of claim 11, wherein the delay value determining unit selects a first delay value of a delayed clock signal corresponding to the first timing and respectively sets sub-delay values of pulses of the clock signal by interpolating the first delay value based on the n-th gate line.

13. The display device of claim 12, wherein the clock generator generates the clock signal by delaying pulses of an external clock signal based on the sub-delay values respectively.

14. The display device of claim 12, wherein the delay value determining unit selects the first delay value of the delayed clock signal corresponding to the first timing and determines a period of the clock signal based on the first delay value.

15. The display device of claim 5, wherein the timing controller determines a first delay value in a first section of the clock signal corresponding to the first gate driving circuit and determines a second delay value in a second section of the clock signal corresponding to a second gate driving circuit among the gate driving circuits based on the first delay value.

16. The display device of claim 5, wherein the gate driving circuits are interconnected through one feedback line and connected to the timing controller through the feedback line.

17. The display device of claim 5, wherein the clock signal includes a plurality of sub-clock signals each provided to corresponding gate driving circuit among the gate driving circuits.

18. A method of driving a display device including a plurality of data lines, a plurality of gate lines, and a plurality of pixels connected to the plurality of data lines and the plurality of gate lines, comprising:

providing data signals to the plurality of data lines through a data driver and sequentially providing a clock signal as a gate signal to the plurality of gate lines through a gate driver;

generating a feedback signal by comparing between a data signal provided to a first data line among the plurality of data lines and at least one of gate signals through the gate driver;

calculating a delay time of the feedback signal based on the clock signal by a timing controller; and setting a delay value of the clock signal based on a change in the delay time of the feedback signal.

19. The method of claim 18, wherein the setting the delay value of the clock signal includes:

determining whether the change in the delay time is out of a reference range;

increasing the delay value for delaying the clock signal when the change in the delay time is within the reference range; and repeating sequentially providing the clock signal as the gate signal to the plurality of gate lines, and generating the feedback signal.

20. The method of claim 19, wherein the setting the delay value of the clock signal further includes:

respectively setting sub-delay values of pulses of the clock signal based on a previous delay value of the clock signal when the change in the delay time is outside of the reference range.

* * * * *